US011682509B2

(12) United States Patent
Chen et al.

(10) Patent No.: US 11,682,509 B2
(45) Date of Patent: Jun. 20, 2023

(54) HIGH FREQUENCY MAGNETIC FILMS, METHOD OF MANUFACTURE, AND USES THEREOF

(71) Applicant: ROGERS CORPORATION, Chandler, AZ (US)

(72) Inventors: Yajie Chen, Brighton, MA (US); Xiaoyu Zhang, Suzhou (CN); Li Zhang, Sichuan (CN); Yuanyuan Xing, Suzhou (CN)

(73) Assignee: ROGERS CORPORATION, Chandler, AZ (US)

( * ) Notice: Subject to any disclaimer, the term of this patent is extended or adjusted under 35 U.S.C. 154(b) by 863 days.

(21) Appl. No.: 16/676,736

(22) Filed: Nov. 7, 2019

(65) Prior Publication Data

US 2020/0161034 A1 May 21, 2020

Related U.S. Application Data

(60) Provisional application No. 62/767,553, filed on Nov. 15, 2018.

(51) Int. Cl.
*H01F 1/16* (2006.01)
*H01F 1/38* (2006.01)
(Continued)

(52) U.S. Cl.
CPC ..... *H01F 1/16* (2013.01); *H01F 1/38* (2013.01); *H01F 41/18* (2013.01); *H01F 41/32* (2013.01); *Y10T 428/32* (2015.01)

(58) Field of Classification Search
None
See application file for complete search history.

(56) References Cited

U.S. PATENT DOCUMENTS 3,020,426 A 2/1962 Van Der Burgt
3,036,007 A 5/1962 Buykx et al.
(Continued)

FOREIGN PATENT DOCUMENTS

CN 104356646 A 2/2015
EP 620571 A2 * 10/1994 ..... B82Y 25/00
(Continued)

OTHER PUBLICATIONS

Bid et al.; "Microstructure Characterization of Mechanosynthesized Nanocrystalling NiFe2O4 by Rietveld's Analysis"; Physica E 39; pp. 175-184; (2007).
(Continued)

*Primary Examiner* — Kevin M Bernatz
(74) *Attorney, Agent, or Firm* — Cantor Colburn LLP

(57) ABSTRACT

A multilayer film includes a substrate; a first magnetic layer disposed on the substrate and a second magnetic layer disposed on the first magnetic layer. The first magnetic layer includes $Fe_{(50-80)}N_{(10-20)}B_{(1-20)}M_{(0-10)}$, wherein M is Si, Ta, Zr, Ti, Co, or a combination thereof. The second magnetic layer includes $Fe_{(50-90)}N_{(10-50)}$ or $Fe_{(60-90)}N_{(1-10)}Ta_{(5-30)}$. The multilayer magnetic film has, over a frequency range of 50 MHz to 10 GHz, a magnetic permeability of greater than or equal to 1800 over a selected frequency band in the frequency range; a magnetic loss tangent of less than or equal to 0.3 over a selected frequency band in the frequency range; and a cutoff frequency of greater than or equal to 1 GHz, or greater than or equal to 2 GHz.

13 Claims, 20 Drawing Sheets

(51) Int. Cl.
*H01F 41/18* (2006.01)
*H01F 41/32* (2006.01)

(56) References Cited

U.S. PATENT DOCUMENTS

| | | | | |
|---|---|---|---|---|
| 5,591,276 | A * | 1/1997 | Yoshizawa | C22C 45/02 420/83 |
| 6,071,430 | A | 6/2000 | Lebourgeois et al. | |
| 6,436,307 | B1 | 8/2002 | Lebourgeois et al. | |
| 6,736,990 | B2 | 5/2004 | Aoki et al. | |
| 7,348,374 | B2 | 3/2008 | Martinazzo | |
| 7,482,977 | B2 | 1/2009 | Kuroda et al. | |
| 10,071,421 | B2 | 9/2018 | Suetsuna et al. | |
| 10,090,088 | B2 | 10/2018 | Suetsuna et al. | |
| 2003/0091841 | A1 | 5/2003 | Marusawa | |
| 2004/0069969 | A1 | 4/2004 | Endo et al. | |
| 2007/0231614 | A1 | 10/2007 | Kondo et al. | |
| 2009/0057606 | A1 | 3/2009 | Tada et al. | |
| 2010/0151797 | A1* | 6/2010 | Viala | H01F 41/32 455/73 |
| 2011/0147643 | A1 | 6/2011 | Ryou et al. | |
| 2012/0068103 | A1 | 3/2012 | Hill et al. | |
| 2012/0229354 | A1 | 9/2012 | Ishikura et al. | |
| 2014/0291571 | A1 | 10/2014 | Hirose | |
| 2014/0346387 | A1 | 11/2014 | Hill et al. | |
| 2016/0086700 | A1 | 3/2016 | Suetsuna et al. | |
| 2016/0086728 | A1 | 3/2016 | Suetsuna et al. | |
| 2016/0099498 | A1 | 4/2016 | Pance et al. | |
| 2016/0113113 | A1 | 4/2016 | Sethumadhavan et al. | |
| 2016/0276072 | A1 | 9/2016 | Sethumadhavan et al. | |
| 2017/0098885 | A1 | 4/2017 | Hill et al. | |
| 2019/0081377 | A1 | 3/2019 | Hill et al. | |
| 2021/0020343 | A1 | 1/2021 | Chen et al. | |

FOREIGN PATENT DOCUMENTS

| | | | |
|---|---|---|---|
| EP | 0620571 | A2 | 10/1994 |
| EP | 1541641 | A1 | 6/2005 |
| EP | 1652829 | A2 | 5/2006 |
| JP | H01200605 | A | 8/1989 |
| JP | 2001085210 | A | 3/2001 |
| WO | 2017068444 | | 4/2017 |
| WO | 2018043943 | A1 | 3/2018 |

OTHER PUBLICATIONS

Chicinas, I.; "Soft Magnetic Nanocrystalline Powders Produced by Mechanical Alloying Routes"; Journal of Optoelectronics and Advanced Materials; 8(2); pp. 439-448; (2006).

International Search Report; International Application No. PCT/US2019/060229; International Filing Date: Nov. 7, 2019;dated Mar. 13, 2020; 7 pages.

Ismail et al.; "Magnetic Properties of Mechanically Alloyed Cobalt-Zinc Ferrite Nanoparticles"; J. Supercond Nov Magn; 27; pp. 1293-1298; (2014).

Koch, C. C.; "Materials Synthesis by Mechanical Alloying"; Annu. Rev. MaterSci. 19; pp. 121-143; (1989).

Koch, C. C.; "Intermetallic Matrix Composites Prepared by Mechanical Alloying—a Review"; Materials Science and Engineering; A244; pp. 39-48; (1998).

Kong et al., "Ni—Zn Ferrites Composites With Almost Equal Values of Permeability and Permittivity for Low-Frequency Antenna Design," IEEE Transactions on Magnetics, Jan. 2007, pp. 6-9, vol. 43, No. 1.

Ohnuma et al., "Soft Magnetic Properties of FeN/FeBN Multilayers," Journal on Magnetics, Nov. 1992, pp. 896-901, vol. 7 No. 11.

Ohnuma et al.,"Soft Magnetic Multilayers for Micromagnetic Devices," Journal of Magnetism and Magnetic Materials, 1993, pp. 556-562, vol. 126.

Sepelak et al.; "Nanocrystalline Nickel Ferrite, NiFe2O4: Mechanosynthesis,Nonequilibrium Cation Distribution, Canted Spin Arrangement, and Magnetic Behavior"; J.Phys.Chem. C; 111; pp. 5026-5033; (2007).

Sepelak et al.; "Structural and Magnetic Properties of Nanosize Mechanosynthesized Nickel Ferrite"; Jounral of Magnetism and Magnetic Materials; 272-276; pp. 1616-1618; (2004).

Waje et al.; "Sintering Temperature dependence of Room Temperature Magnetic and Dielectric Properties of Co0.5Zn0.5F32O4 Prepared using Mechanically Alloyed Nanoparticles"; Journal of magnetism and Magnetic Materials; 322; pp. 686-691; (2010).

Written Opinion; International Application No. PCT/US2019/060229; International Filing Date: Nov. 7, 2019;dated Mar. 13, 2020; 8 pages.

Martin et al.; "Flexible Magnetic Composites"; Passive RF Component Technoloby, Materials Techniques and Applications; Chapter 8; 2012; pp. 156-185.

Thakur et al; "Low-loss Spinel Nanoferrite With Matching Permeability and Permittivity in the Ultrahigh Frequency Range"; Journal of Applied Physics; 108, 014301; (2010).

Yang, Guo-Min, et al., "Miniaturized Patch Antennas with Ferrite/Dielectric/Ferrite Magnetodielectric Sandwich Substrate", Piers Online, vol. 7, No. 7, (Jan. 1, 2011), pp. 609-612.

Pullar, "Hexagonal Ferrites: A Review of the synthesis, properties and application of hexaferrite ceramics," Mar. 2012, Progress in Material Science, vol. 57, No. 7, pp. 1191-1334.

Raja et al., "1.12: An Introduction to Energy Dispersive X-ray Spectroscopy", p. 80-84, from "Physical Methods in Chemistry and Nano Science", LibreText,Text Compiled on Dec. 5, 2022; 693 pages.

* cited by examiner

HIGH FREQUENCY MAGNETIC FILMS, METHOD OF MANUFACTURE, AND USES THEREOF

CROSS REFERENCE TO RELATED APPLICATION

This application claims the benefit of U.S. Provisional Patent Application Ser. No. 62/767,553 filed Nov. 15, 2018. The related application is incorporated herein in its entirety by reference.

BACKGROUND

This disclosure relates generally to high frequency magnetic films, methods for their manufacture, and uses thereof, for example in integrated circuits, power supply systems, antennas, and the like.

Newer designs and manufacturing techniques have driven electronic components to increasingly smaller dimensions and higher frequencies. One approach to reducing electronic component size has been the use of magnetic materials. In particular, ferrites, ferroelectrics, and multiferroics have been widely studied as functional materials with enhanced microwave properties. While the high permeability of magnetic materials increases the DC value of inductance, it remains a challenge to extend that magnetic permeability and corresponding inductance enhancement to high frequencies (e.g., 1 to 5 gigahertz (GHz)), which are desired for various mobile applications. Magnetic permeability at these frequencies is sharply deteriorated due to Snoek's limit of the materials. At the intrinsic ferromagnetic resonance (FMR) frequency of magnetic materials (typically 1-2 GHz for large blanket films), the relative magnetic permeability drops to unity and the magnetic loss tangent peaks, such that the inductance enhancement due to the material is negligible and the losses are dominant. It is possible to enhance the frequency response of magnetic permeability by varying methods of definition and patterning of the materials, but there still remains a need in the art for materials and methods that can provide high magnetic permeability and high resonance frequency over high bandwidths.

BRIEF DESCRIPTION

Disclosed herein is a multi-layer magnetic film and a method of making the same.

In an embodiment, a multilayer film includes a substrate; a first magnetic layer disposed on the substrate and a second magnetic layer disposed on the first magnetic layer. The first magnetic layer includes $Fe_{(50-80)}N_{(10-20)}B_{(1-20)}M_{(0-10)}$, wherein M is Si, Ta, Zr, Ti, Co, or a combination thereof. The second magnetic layer includes $Fe_{(50-80)}N_{(10-20)}B_{(1-20)}M_{(0-10)}$. The multilayer magnetic film has, over a frequency range of 50 megahertz (MHz) to 10 GHz, preferably over a frequency range of 100 MHz to 5 GHz, more preferably over a frequency range of 1 to 5 GHz, a magnetic permeability of greater than or equal to 1800, preferably greater than or equal to 2000, more preferably greater than or equal to 3000 to 5000 over a selected frequency band in the frequency range, preferably over a frequency band of 1 to 10 GHz; a magnetic loss tangent of less than or equal to 0.3, preferably less than or equal to 0.1, more preferably 0.01 to 0.1 over a selected frequency band in the frequency range, preferably over a frequency band of 1 to 10 GHz; and a cutoff frequency of greater than or equal to 1 GHz, or greater than or equal to 2 GHz, preferably greater than or equal to 5 GHz, or 1 to 8 GHz.

In an embodiment, a method of forming the multilayer film includes depositing the first magnetic layer onto a side of the substrate; and depositing the second magnetic layer onto a side of the first magnetic layer opposite to the substrate.

Articles includes the multi-layer magnetic films are further described. The article is preferably a filter, transformer, inductor, antenna, electronic integrated circuit chip, or electromagnetic shielding device.

The above and other features and advantages are readily apparent from the following detailed description, examples, and claims when taken in connection with the accompanying drawings.

BRIEF DESCRIPTION OF THE DRAWINGS

Referring to the exemplary non-limiting figures wherein like elements are numbered alike.

DETAILED DESCRIPTION

The inventors hereof have developed multilayer magnetic films with a combination of high magnetic permeability, low loss, and excellent inductance over a broad frequency range. The magnetic thin-films integrated with complementary metal-oxide-semiconductor (CMOS) enable high-quality, high density, low-profile, on-chip/in-package inductive components.

The multilayer films are disposed on a substrate, and include a first magnetic layer, wherein the first magnetic layer comprises $Fe_{(50-80)}N_{(10-20)}B_{(1-20)}M_{(0-10)}$, wherein M is Si, Ta, Zr, Ti, Co, Nb, or a combination thereof (herein referred to as FeNB); and a second magnetic layer wherein the second magnetic layer comprises $Fe_{(50-90)}N_{(10-50)}$ (herein referred to as FeN) or $Fe_{(60-90)}N_{(1-10)}Ta_{(5-30)}$ (herein referred to as FeNTa). The multilayer magnetic films can operate over a frequency range of 50 MHz to 10 GHz and can have a magnetic constant (also known as a magnetic permeability) of greater than or equal to 1800 and a magnetic loss tangent of less than or equal to 0.3 measured over a selected frequency band.

Figure 1:
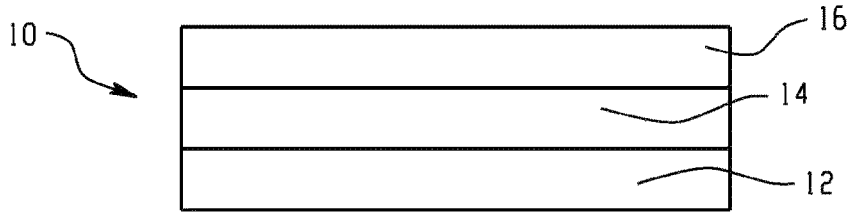
FIG. 1 is a cross-sectional view of an embodiment of a multilayer magnetic film.

An illustration of a cross-sectional view of a multilayer magnetic film 10 is shown in FIG. 1. Substrate 12 has a first side, i.e., a first planar surface and a second side, i.e., an opposite second planar surface. The substrate 12 can be of any suitable material, for example a glass, an organic polymer, or a ceramic. In an aspect, the substrate comprises a ceramic such as at least one of MgO, Sic, $Si_3N_4$, alumina, silicon, or the like. The substrate can be amorphous, single crystal, or polycrystalline. The substrate 12 can have any suitable thickness, which will depend on its support properties and the intended application. For example, the substrate can have a thickness of 100 micrometers to 1 millimeters.

The first magnetic layer 14 is disposed on the first side of the first planar surface. As stated above, the first magnetic layer comprises $Fe_{(50-80)}N_{(10-10)}B_{(1-20)}M_{(0-10)}$, wherein M is Si, Ta, Zr, Ti, Co, Nb, or a combination thereof. In a preferred aspect, the first magnetic layer comprises $Fe_{(50-80)}N_{(10-20)}B_{(1-20)}$, wherein the amount of M is 0. The first magnetic layer can have a thickness of 10 to 100 nanometers, for example 10 to 50 nanometers or 20 to 80 nanometers.

A second magnetic layer 16 is disposed on a side of the first magnetic layer opposite the substrate. The second magnetic layer comprises $Fe_{(50-90)}N_{(10-50)}$ or $Fe_{(60-90)}N_{(1-10)}Ta_{(5-30)}$. The second magnetic layer can have a thickness of 10 to 400 nanometers, for example 10 to 300 nanometers, or 50 to 400 nanometers.

Figure 2:
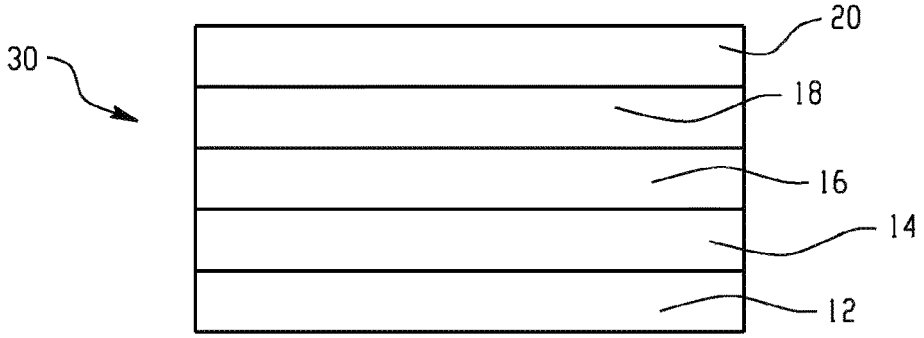
FIG. 2 is a cross-sectional view of another embodiment of a multilayer magnetic film.

The multilayer magnetic film can include additional layers, in particular additional alternating first and second layers. As shown in FIG. 2, an additional first magnetic layer 16, comprising $Fe_{(50-80)}N_{(10-20)}B_{(1-20)}$, is disposed on the second magnetic layer 14. An additional second magnetic layer 18, comprising $Fe_{(50-90)}N_{(10-50)}$ or $Fe_{(60-90)}N_{(1-10)}Ta_{(5-30)}$, is disposed on the additional first magnetic layer 16. Further additional first and second magnetic layers can be disposed on the additional second magnetic layer in alternation (not shown).

The first magnetic layer 14 and the second magnetic layer 16 can have a total thickness of 20 to 500 nanometers. In an embodiment the first magnetic layer 14 has a thickness of 10 to 200 nm, and the second magnetic layer can have a thickness of 10 to 400 nm. In a particularly advantageous feature, the thickness of each of the magnetic layers, the ratio of the thickness, or both, can be adjusted to obtain a desired magnetic loss tangent of the multilayer magnetic film, a desired magnetic anisotropy of the magnetic multilayer film, or both.

A method of forming the multilayer magnetic film includes depositing the first magnetic layer onto a side of the substrate; and depositing the second magnetic layer onto a side of the first magnetic layer opposite to the substrate. Deposition of alternating layers proceeds until the entire film is manufactured. Deposition can be by rf/DC sputtering, electron beam deposition, or a combination thereof.

The multilayer magnetic films can be used over a frequency range of 50 MHz to 10 GHz, preferably over a frequency range of 100 MHz to 5 GHz, more preferably over a frequency range of 1 to 5 GHz.

The multilayer magnetic films can have a magnetic permeability of greater than or equal to 1800, preferably greater than or equal to 2000, more preferably greater than or equal to 3000, or 1800 to 5000 over a selected frequency band in the frequency range, preferably over a frequency band of 1 to 10 GHz. As used herein, this terminology refers to the multilayer magnetic films having at least one instance of the magnetic permeability being greater than or equal to 1800 over the frequency band of 1 to 5 GHz, or 1 to 10 GHz.

The multilayer magnetic films can have a magnetic loss tangent of less than or equal to 0.3, or less than 0.3, preferably less than or equal to 0.1, or less than 0.1, or 0.01 to 0.3 over a selected frequency band in the frequency range, preferably over a frequency band of 1 to 10 GHz. As used herein, this terminology refers to the multilayer magnetic films having at least one instance of the magnetic loss tangent being less than or equal to 0.3 over the frequency band of 1 to 5 GHz, or 1 to 10 GHz.

The multilayer magnetic films can have a cutoff frequency of greater than or equal to 1 GHz, or greater than 1 GHz, or greater than or equal to 2 GHz, preferably greater than or equal to 5 GHz, or 1 to 8 GHz.

The multilayer magnetic films can include additional layers, for example, a top layer. The top layer can include $Al_2O_3$. The top layer can include an insulating cap.

The multilayer magnetic films can be used in electronic devices such as filters or inductors on electronic integrated circuit chips for a wide variety of applications, for example, electric power applications, data storage, and microwave communication. The multilayer magnetic film can be used in low frequency applications, for example, at a frequency of 50 MHz to 1 GHz, or in high frequency applications, for example 1 to 10 GHz. The multilayer magnetic film can be used in antennas, and in electronic devices such as mobile internet devices, and in electronic devices, for example, cell phones, tablets, desktop computers, laptop computers, notebook computers, and the like. In an aspect, the device is a portable electronic device, for example a handheld electronic device. The multilayer magnetic films can further be used in power supply systems and antennas. The multilayer magnetic films can advantageously be used in integrated electronic devices.

The following examples are provided to illustrate the present disclosure. The examples are merely illustrative and are not intended to limit devices made in accordance with the disclosure to the materials, conditions, or process parameters set forth therein.

EXAMPLES

Figure 3:
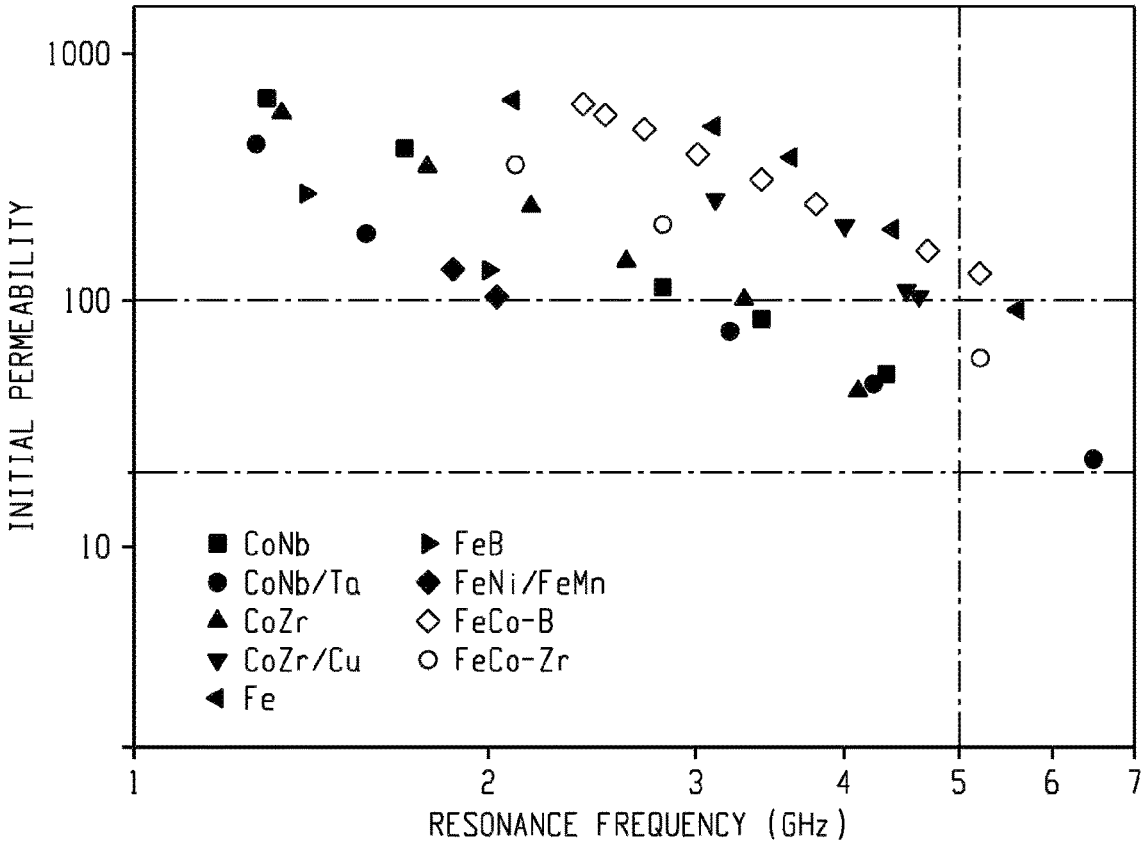
FIG. 3 is a plot showing the high frequency characteristics of comparative Co- and Fe-based thin films and multilayers measured at room temperature.

FIG. 3 is a plot showing initial magnetic permeability versus resonance frequency/gigahertz (GHz) of various comparative films, reproduced from Chin. Phys. B Vol. 24, No. 5 (2015) 05750.

Example 1: FeN/FeNB/Glass Bi-Layered Film Structure

Parameters for RF Magnetron Sputtering:

- RF Power=80 to 120 Watts (W)
- Deposition pressure=0.3 to 0.6 pascals (Pa)
- Distance between target and substrate=8 centimeters (cm)
- Working gas: Argon; Reaction gas: Nitrogen
- Target:
  - Iron (99.9%), 2-inch (5.08 cm) disk;
  - 2 pieces of boron (99.9%) chip with 2.5×2.5 square millimeters ($mm^2$)
- Deposition time: 5 to 30 minutes
- Deposition temperature: ambient
- Substrate: Optical glass Single Layer of FeN Film on Glass Substrate (Reference Example)

Figure 4:
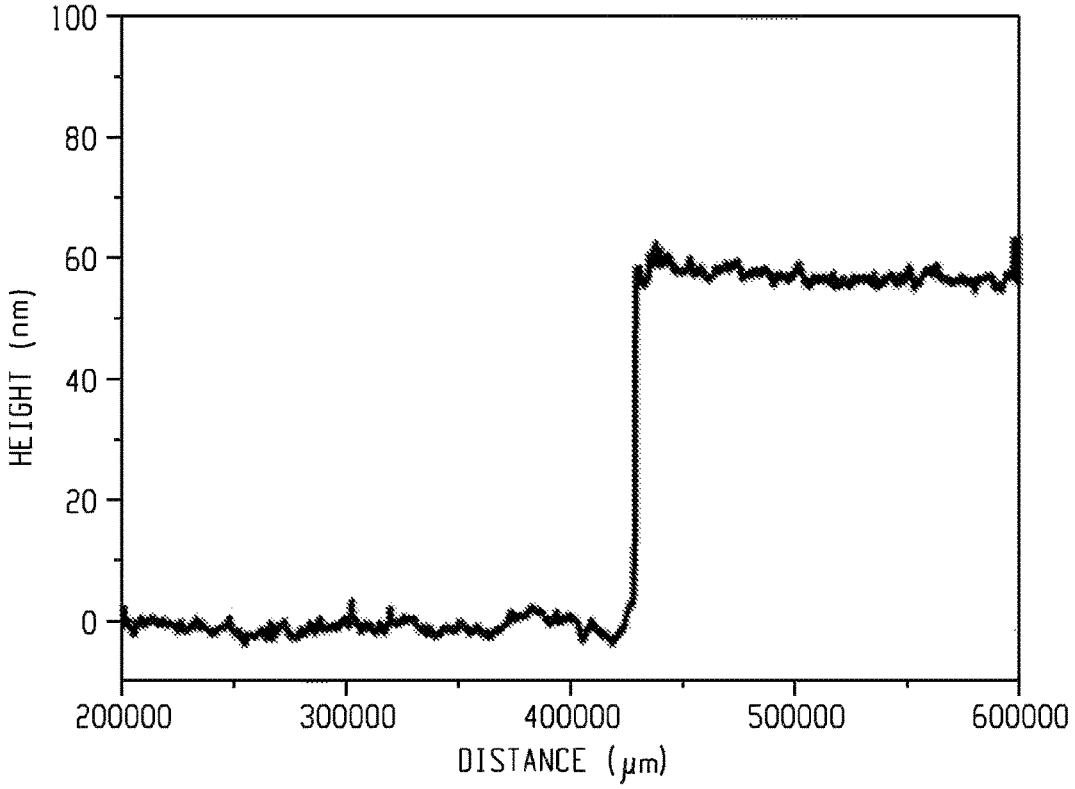
FIG. 4 is a surface profile of an FeN film by profilometry and atomic force microscopy (AFM)
Figure 5:
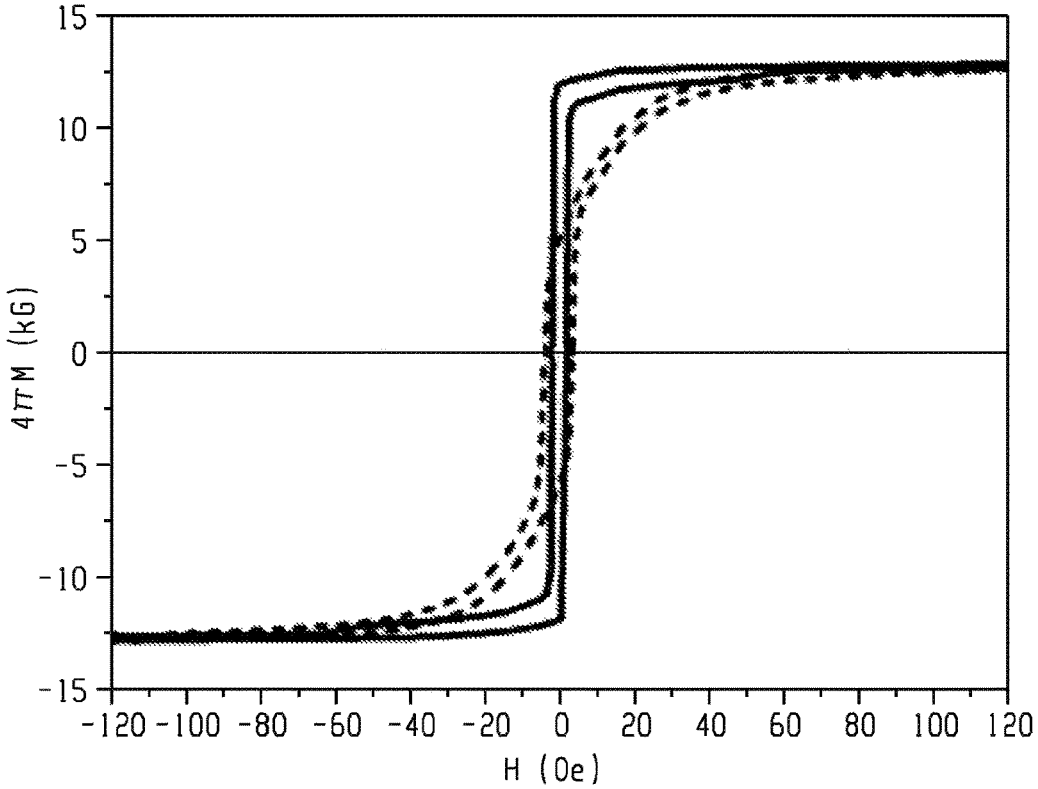
FIG. 5 is a magnetic hysteresis of FeN films along easy and hard magnetizing directions in a plane of the film.
Figure 6:
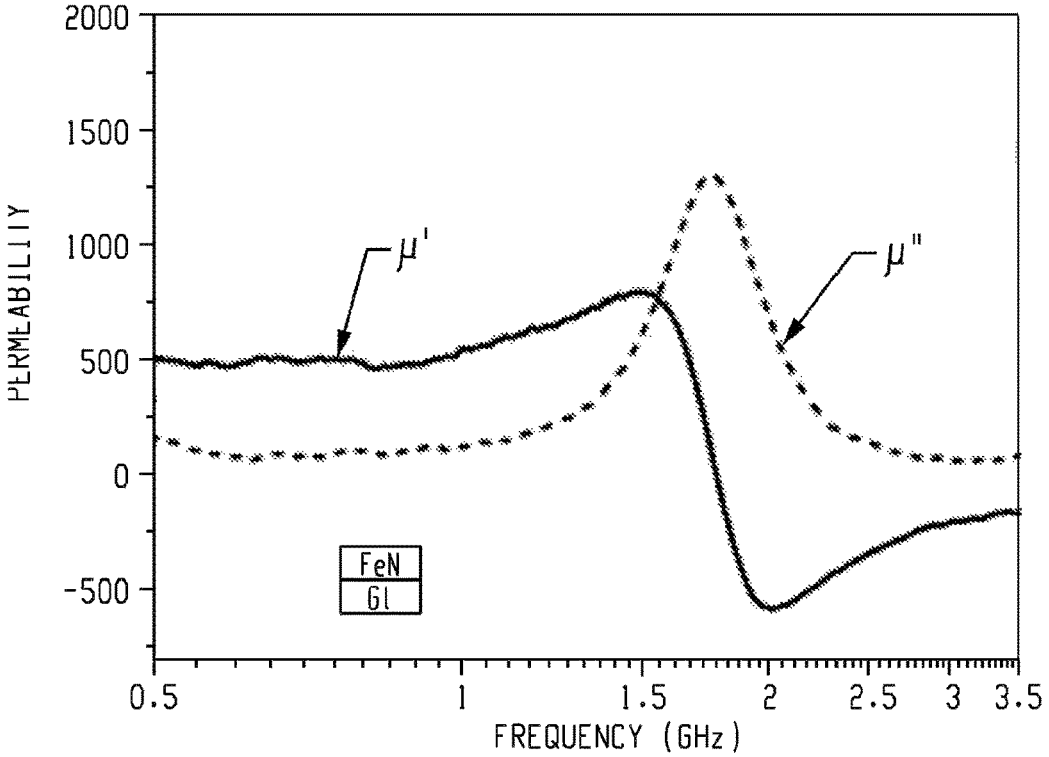
FIG. 6 is a magnetic permeability spectrum of an FeN film with 60 nanometer (nm) thickness.
Figure 13:
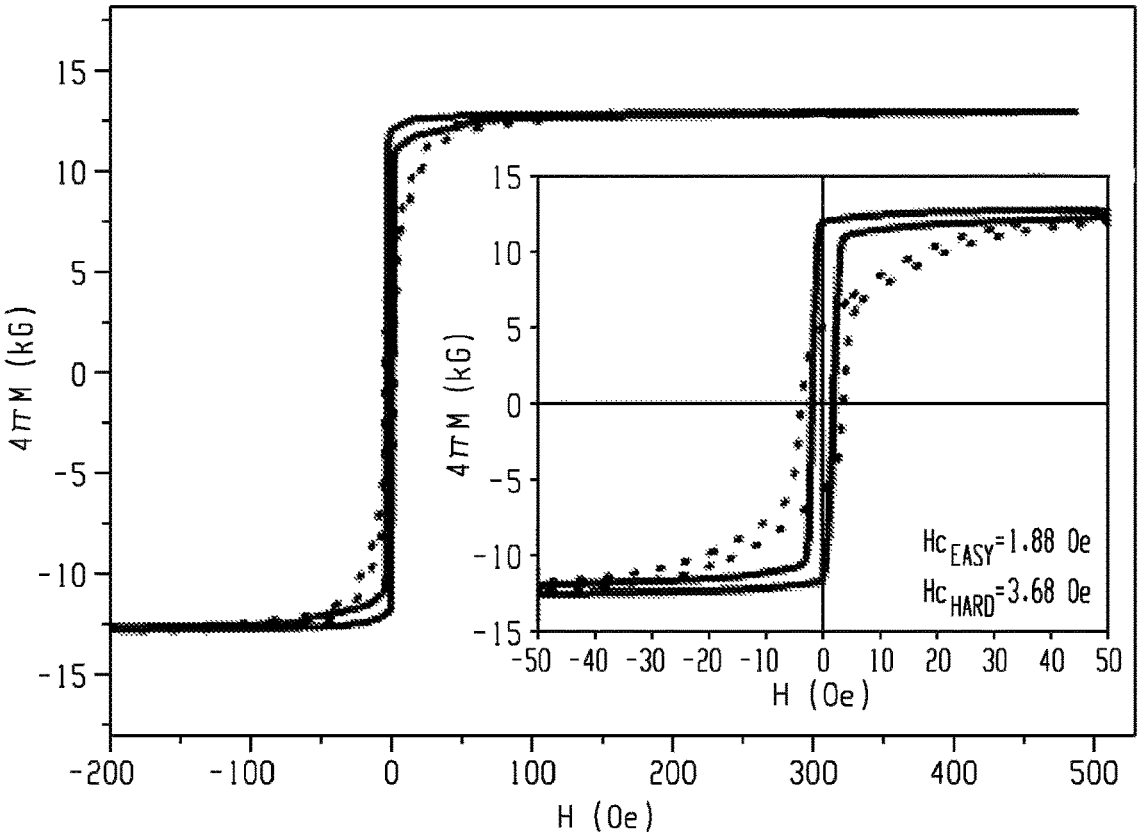
FIG. 13 is a magnetic hysteresis of an FeTaN film with thickness of 80 nm along x and y directions in a plane of the film.

With reference to FIGS. 4-6, an FeN film had a composition of $Fe_{74}N_{26}$ and thickness of 60 nanometers (nm) on a glass substrate, measured by (energy-dispersive X-ray spectroscopy) EDXS and profilometry, respectively. EDXS provides elemental analysis of the composition, and as such it will be understood that the subscripts in the Formula (i.e., $Fe_{74}N_{26}$) refer to the atomic ratio of each element (i.e., Fe to N). In the figures, the abbreviation Gl stands for glass. The FeN film having a film thickness of 60 nm exhibited a fine grain size of 11 nm by atomic force microscopy (AFM). The FeN film exhibited magnetic anisotropy in the film plane depicted in magnetic hysteresis loops. The FeN film had a magnetic permeability (μ') of 510 at 0.5 gigahertz (GHz) and a magnetic loss tangent (tan δ) of 0.3 and retained a resonance frequency of 1.71 GHz. The FeN film had a Snoek product of $0.87\times10^{12}$. A summary of magnetic properties for the 60 nm thick FeN film on glass substrate is provided in Table 1. In FIGS. 5 and 13, Easy (solid lines) or Hard (dashed lines) magnetizing direction indicates an energetically favorable or unfavorable direction of spontaneous magnetization, respectively.

TABLE 1

| Film thickness | 0.5 GHz | | 1 GHz | | 1.5 GHz | | $f_r$ | Snoek product | 4πMs | Hc |
|---|---|---|---|---|---|---|---|---|---|---|
| (nm) | μ' | tanδ | u' | Tanδ | u' | tanδ | (GHz) | ($\times10^{12}$) | (kG) | (Oe) |
| 60 | 510 | 0.31 | 539 | 0.22 | 788 | 0.84 | 1.71 | 0.87 | 12.43 | 1.9 |

Single Layer of FeNB Film on Glass Substrate (Reference Example)

Figure 7:
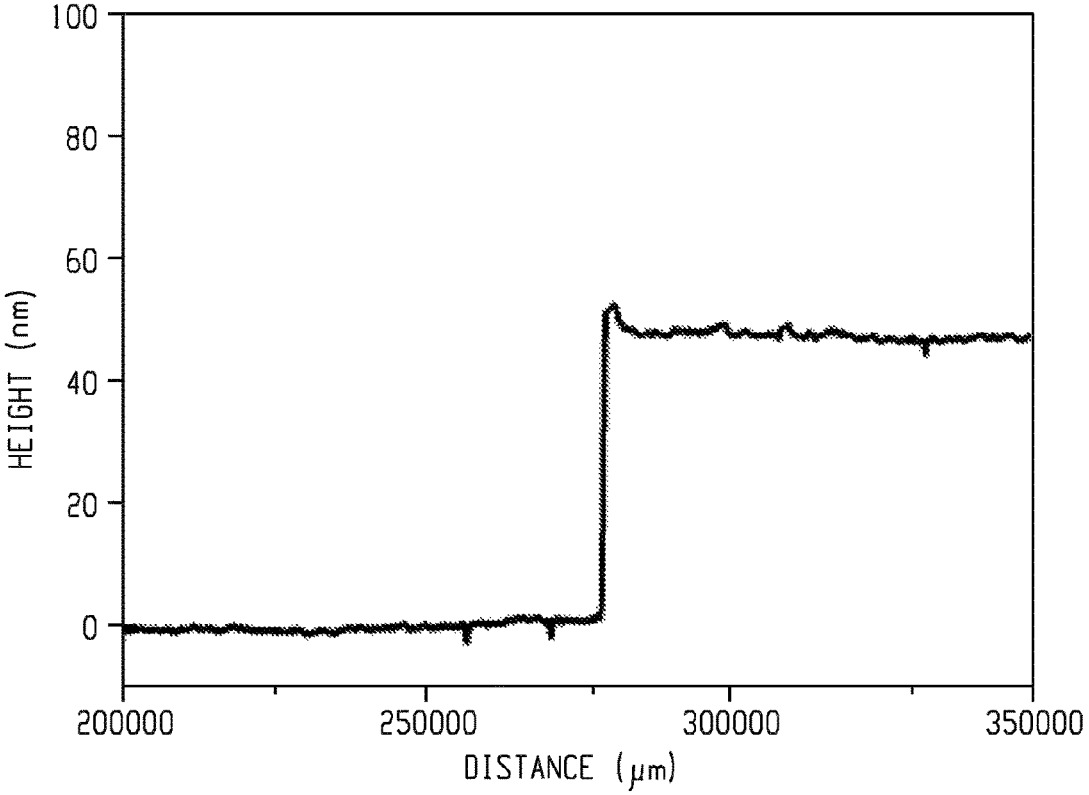
FIG. 7 is a surface profile of an FeN film by profilometry and AFM.
Figure 8:
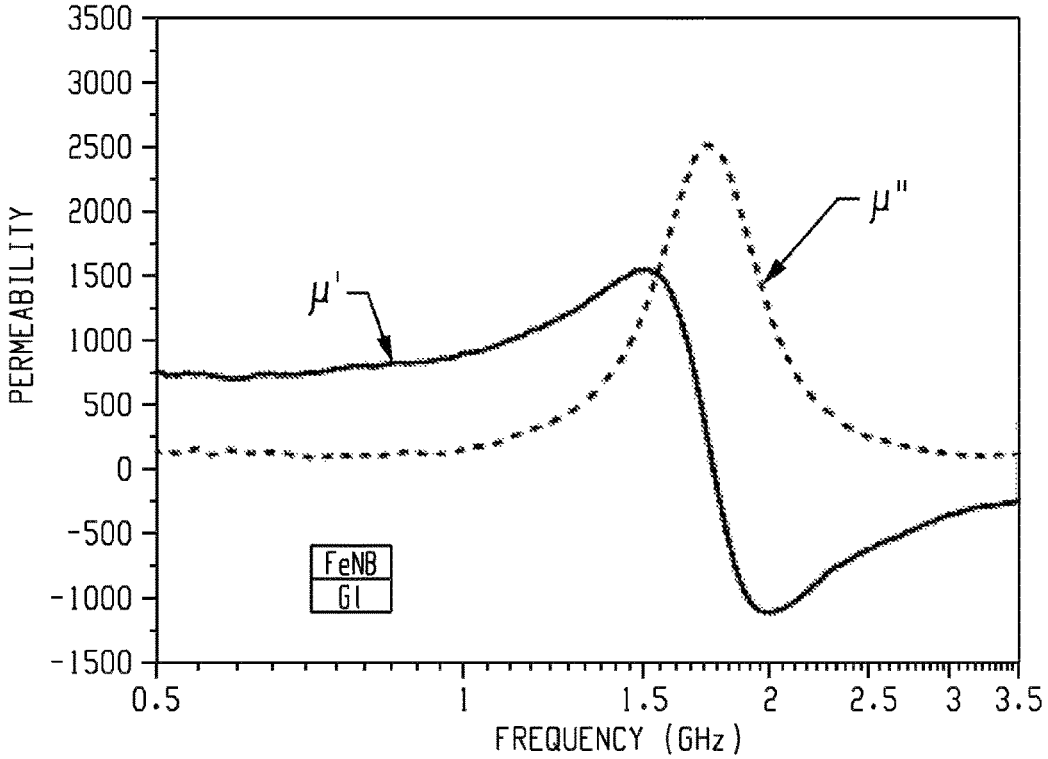
FIG. 8 is a magnetic permeability spectrum of an $Fe_{66}N_{18}B_{16}$ film with 50 nm thickness.

With reference to FIGS. 7 and 8, the FeNB film on a glass substrate had a composition of $Fe_{66}N_{18}B_{16}$ and thickness of 50 nm and an average grain size of 6.7 nm, measured by EDXS and profilometry, respectively. The FeNB film on a glass exhibited a magnetic permeability of 864 at 1 GHz and Snoek product of $1.26\times10^{12}$, respectively. A summary of magnetic measurements for the $Fe_{66}N_{18}B_{16}$ film is provided in Table 2.

TABLE 2

| Film thickness | 0.5 GHz | | 1 GHz | | 1.5 GHz | | $f_r$ | Snoek product |
|---|---|---|---|---|---|---|---|---|
| (nm) | μ' | tanδ | u' | Tanδ | u' | tanδ | (GHz) | ($\times10^{12}$) |
| 50 | 730 | 0.19 | 864 | 0.18 | 1547 | 0.80 | 1.73 | 1.26 |

Figure 9:
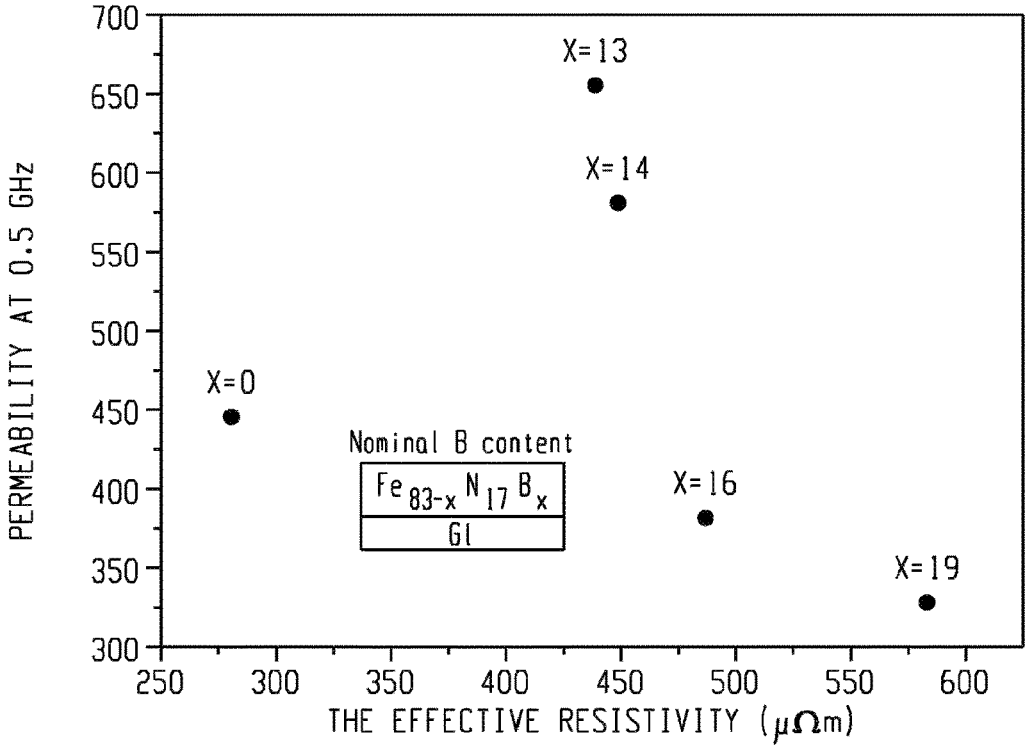
FIG. 9 shows the relationship between effective resistivity and magnetic permeability of an $Fe_{83-x}N_{17}B_x$ film with differing boron content.

With reference to FIG. 9, the effective resistivity of the FeNB film increased with an increase in the content of boron (x=0, 13, 14, 16, 19). The magnetic permeability at 0.5 GHz was increased in the resistivity range from 400 to 450 microohm meters (μΩm).

FeN/FeNB Bi-Layer on a Glass Substrate

Figure 10:
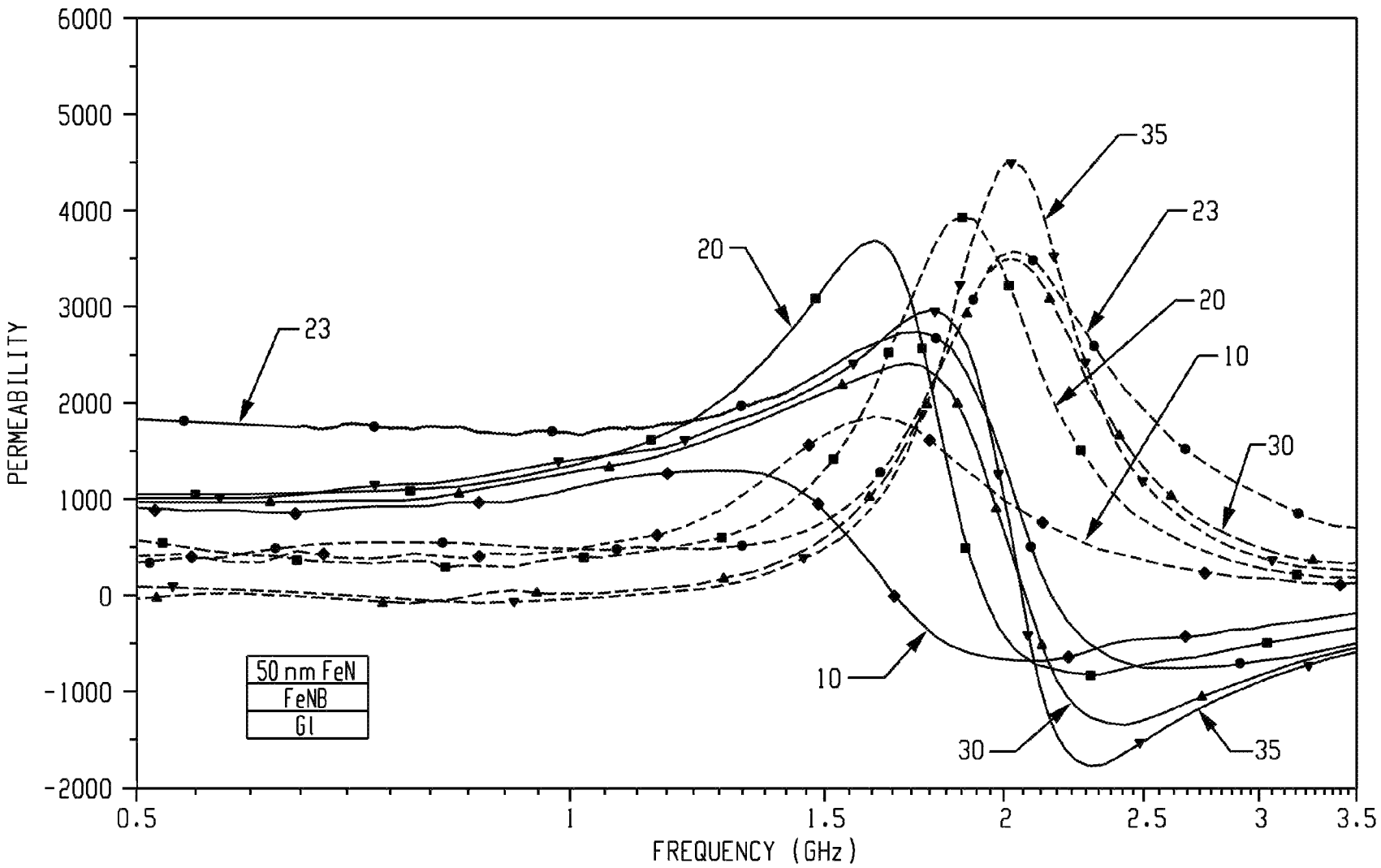
FIG. 10 is magnetic spectra of $Fe_{74}N_{26}/Fe_{66}N_{18}B_{16}$ bi-layer films with various thicknesses of FeNB.

An $Fe_{66}N_{18}B_{16}$ film was deposited onto a glass substrate, followed by deposition of an $Fe_{74}N_{26}$ film with a constant thickness of 50 nm. The thickness of the $Fe_{66}N_{18}B_{16}$ film was in a range of 10-35 nm, varying with deposition time. FIG. 10 shows μ' (solid lines) and μ" (dashed lines) for varying thicknesses of the $Fe_{66}N_{18}B_{16}$ film in nm as indicated on the figure.

With reference to FIG. 10, an FeN (50 nm)/FeNB (23 nm) bi-layer film exhibited a high magnetic permeability of 1832 at 0.5 GHz and Snoek product of $3.72\times10^{12}$, respectively. The FeN (50 nm)/FeNB (23 nm) bi-layer film exhibited high magnetic permeability of 2313 at 1.5 GHz. The composition of the FeNB film was measured to be $Fe_{66}N_{18}B_{16}$ by EDXS. A summary of magnetic measurements for the FeN/FeNB bi-layered films with different thicknesses of the FeNB layer is provided in Table 3.

TABLE 3

| Film thickness | 0.5 GHz | | 1 GHz | | 1.5 GHz | | $f_r$ | Snoek product |
|---|---|---|---|---|---|---|---|---|
| (nm) | μ' | tanδ | u' | tanδ | u' | tanδ | (GHz) | ($\times10^{12}$) |
| 10 | 899 | 0.44 | 1103 | 0.44 | 853 | 1.98 | 1.62 | 1.46 |
| 20 | 1062 | 0.53 | 1366 | 0.30 | 3221 | 0.41 | 1.83 | 1.94 |
| 23 | 1832 | 0.21 | 1679 | 0.27 | 2313 | 0.33 | 2.03 | 3.72 |

TABLE 3-continued

| Film thickness | 0.5 GHz | | 1 GHz | | 1.5 GHz | | $f_r$ | Snoek product |
|---|---|---|---|---|---|---|---|---|
| (nm) | μ' | tanδ | u' | tanδ | u' | tanδ | (GHz) | ($\times 10^{12}$) |
| 30 | 1042 | 0.02 | 1275 | 0.01 | 2069 | 0.29 | 2.01 | 2.09 |
| 35 | 853 | 0.09 | 1375 | 0.01 | 2201 | 0.23 | 2.01 | 1.71 |

Example 2: FeN/FeNB/Glass Bi-Layered Film Structure with Low Level of Boron Content Parameters for RF Magnetron Sputtering:

RF Power=80 to 120 W

Deposition pressure=0.3 to 0.6 pascals (Pa)

Distance between target and substrate=8 centimeters (cm)

Working gas: Ar; Reaction gas: Nitrogen

Target:

Iron (99.5%), 2-inch disk 2 pieces of boron (99.5%) chip with 2.5×2.5 $mm^2$

Deposition time: 5 to 30 minutes

Deposition temperature: ambient

Substrate: Optical glass

In this example, an FeNB film was deposited onto a glass substrate, followed by a 50 nm thick FeN film deposited on the top of the FeNB film at ambient temperature. The thickness of the FeNB film varied with deposition time, and a constant thickness of 50 nm for the FeN film was retained.

Figure 11:
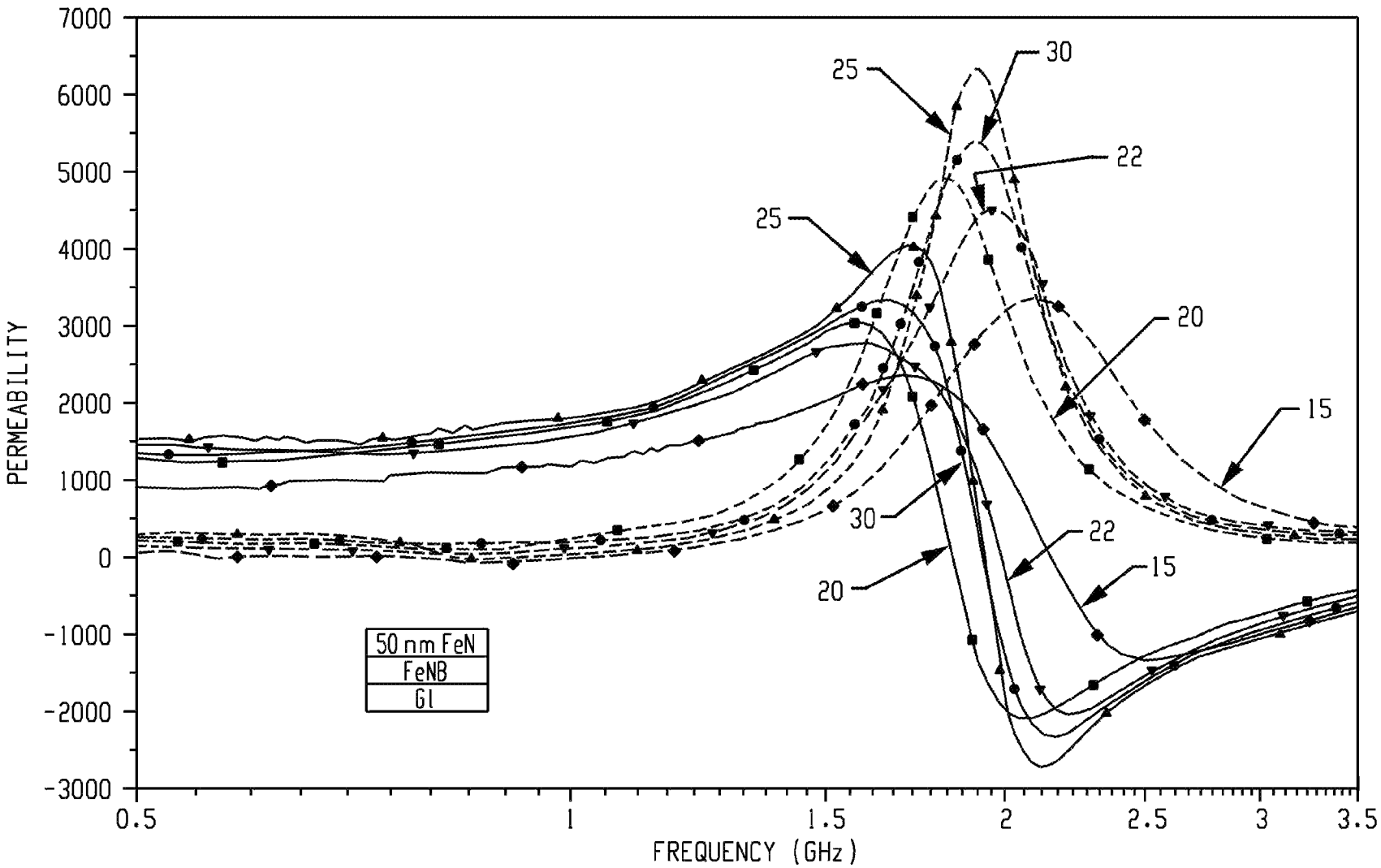
FIG. 11 is a magnetic permeability for $Fe_{74}N_{26}/Fe_{72}N_{18}B_{10}$ bi-layer films with different thicknesses of $Fe_{72}N_{18}B_{10}$.

Magnetic Permeability Spectra for FeN/FeNB Films with Low Level of Boron Content With reference to FIG. 11, the FeNB film had a composition of $Fe_{72}N_{18}B_{10}$, and the FeN had a composition of $Fe_{74}N_{26}$ measured by EDXS. FIG. 11 shows (solid lines) and μ" (dashed lines) for varying thicknesses of the $Fe_{66}N_{18}B_{10}$ film in nm as indicated on the figure. The bi-layered film structure exhibited an increased magnetic permeability from 1207 to 1741 with an increased thickness of the FeNB seed layer from 15 nm to 25 nm. The Snoek product of the FeN/FeNB film increased by 60% with an increase of thickness of the FeNB seed layer from 15 nm to 25 nm. A summary of magnetic spectrum measurements for the $Fe_{74}N_{26}/Fe_{72}N_{18}B_{10}$ bi-layer films is provided in Table 4.

TABLE 4

| FeNB thickness in FeN | 0.5 GHz | | 1 GHz | | 1.5 GHz | | $f_r$ | Snoek product |
|---|---|---|---|---|---|---|---|---|
| (50 nm)/FeNB/Glass (nm) | μ' | tanδ | u' | tanδ | u' | tanδ | (GHz) | ($\times 10^{12}$) |
| 15 | 895 | 0.08 | 1207 | 0.04 | 2023 | 0.31 | 2.08 | 1.86 |
| 20 | 1248 | 0.18 | 1707 | 0.15 | 2951 | 0.58 | 1.81 | 2.26 |
| 22 | 1427 | 0.11 | 1599 | 0.05 | 2690 | 0.45 | 1.96 | 2.80 |
| 25 | 1561 | 0.18 | 1741 | 0.06 | 3094 | 0.27 | 1.91 | 2.98 |
| 30 | 1297 | 0.16 | 1657 | 0.13 | 2972 | 0.38 | 1.91 | 2.48 |

Figure 12:
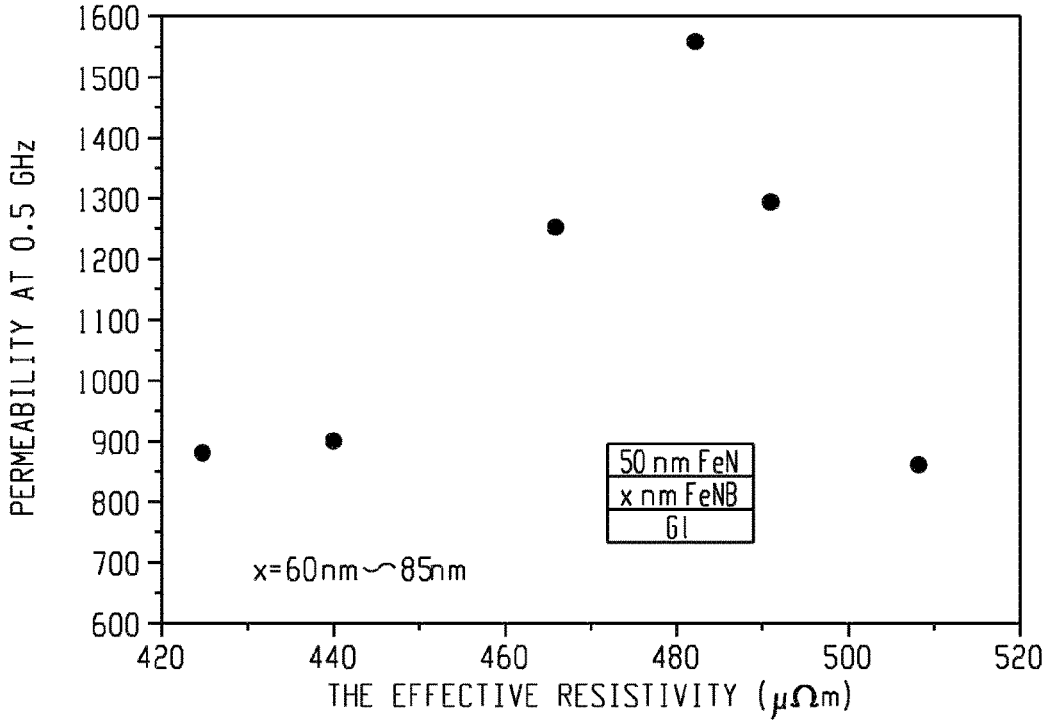
FIG. 12 shows the relationship between effective resistivity and magnetic permeability of an $Fe_{82}N_{18}/Fe_{72}N_{18}B_{10}$/glass film with different thicknesses of an FeNB layer.

Resistivity Versus Magnetic Permeability (at 0.5 GHz) for a FeN/FeNB/Glass Structure With reference to FIG. 12, the effective resistivity of the FeN/FeNB/Glass film was affected by the thickness of the FeNB seed layer. The resistivity increased with an increase of the FeNB thickness. Magnetic permeability at 0.5 GHz was increased in the resistivity range from 460 to 490 μΩm.

Example 3: FeTaN/FeNB/Glass Bi-Layered Structure Parameters for RF Magnetron Sputtering RF Power=80 to 120 W Deposition pressure=0.3 to 0.6 pascals (Pa)

Distance between target and substrate=8 centimeters (cm)

Working gas: Ar (99.5%); Reaction gas: Nitrogen (99.0%)

Target:

Iron (99.5%), 2-inch disk 2 pieces of boron (99.5%) chip with 5×5 $mm^2$

Deposition time: 5 to 30 minutes

Deposition temperature: ambient

Substrate: Optical glass

Figure 14:
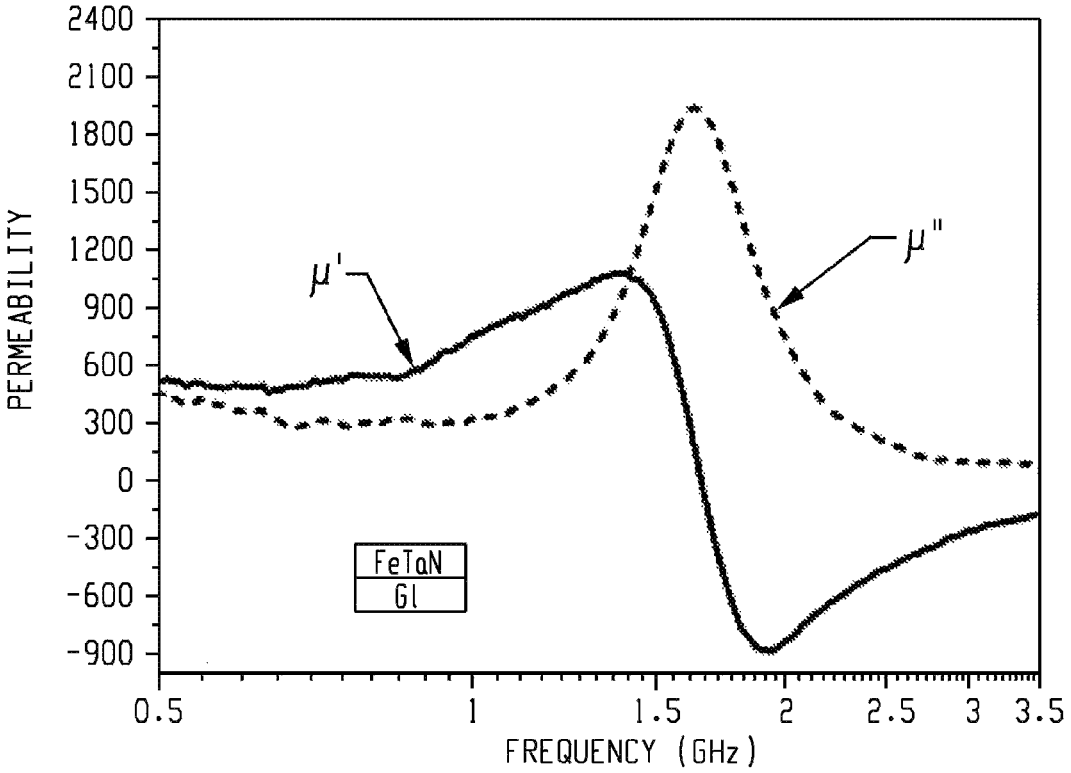
FIG. 14 is a magnetic permeability spectrum of 80 nm-thick $Fe_{74}Ta_6N_{20}$ film on a glass substrate.

Magnetic Properties and Magnetic Permeability of Single FeTaN Film on a Glass Substrate With reference to FIGS. 13 and 14, a summary of magnetic spectrum measurements for a $Fe_{74}Ta_6N_{20}$ single film is provided in Table 5.

TABLE 5

| Film thickness | 0.5 GHz | | 1 GHz | | 1.5 GHz | | $f_r$ | Snoek product | 4πMs | Hc |
|---|---|---|---|---|---|---|---|---|---|---|
| (nm) | μ' | tanδ | u' | Tanδ | u' | tanδ | (GHz) | ($\times 10^{12}$) | (kG) | (Oe) |
| 80 | 539 | 0.85 | 752 | 0.41 | 876 | 1.78 | 1.63 | 0.88 | 12.9 | 1.88 |

Magnetic Permeability of Bi-Layered FeTaN/FeNB Films on the Glass Substrate

Figure 15:
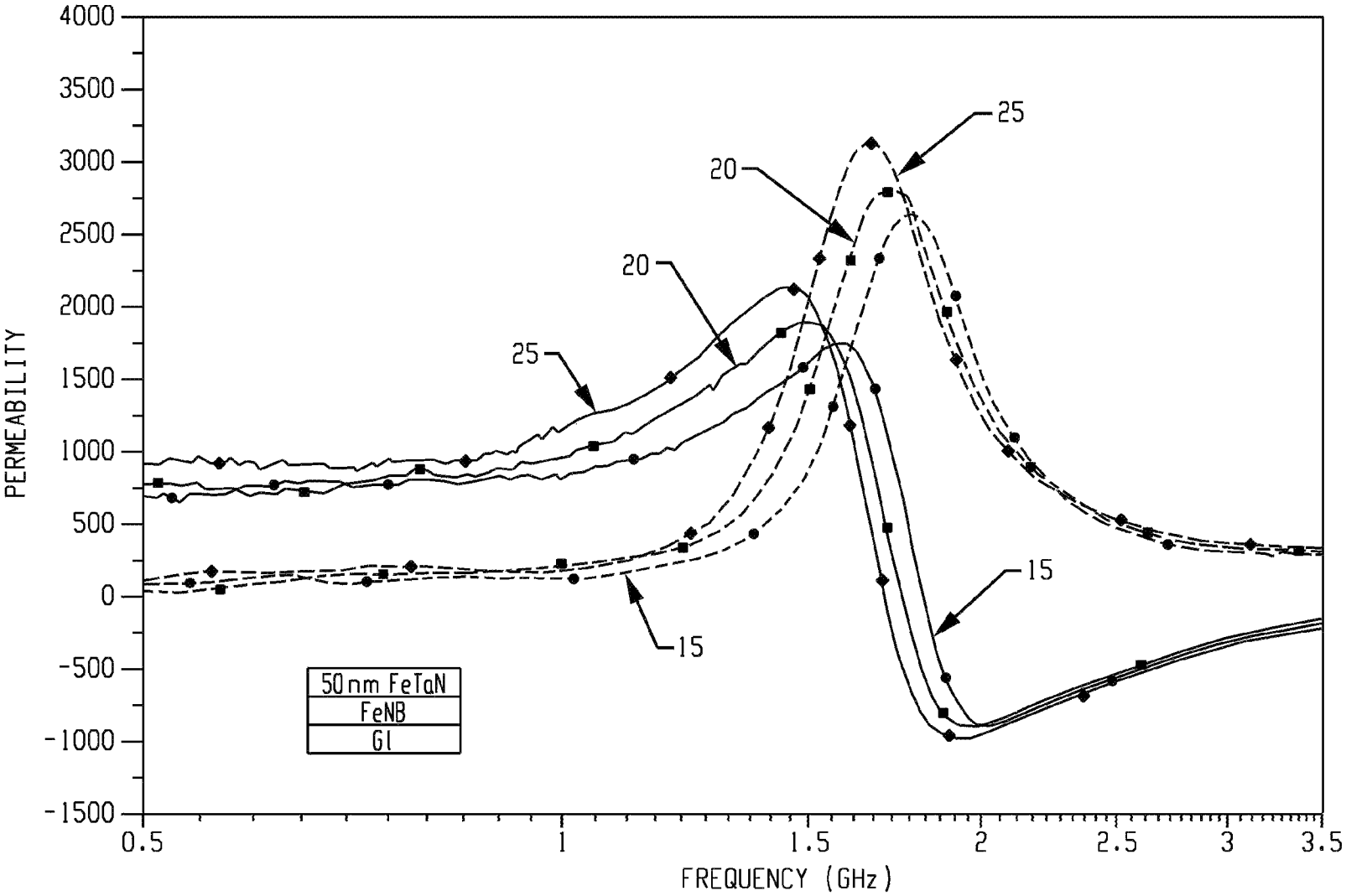
FIG. 15 is magnetic spectra for $Fe_{74}Ta_6N_{20}/Fe_{66}N_{18}B_{16}$ bi-layer films.

With reference to FIG. 15, the bi-layered film structure included $Fe_{74}Ta_6N_{20}$ and $Fe_{66}N_{18}B_{16}$ films deposited on a glass substrate. A summary of magnetic spectrum measurements for $Fe_{74}Ta_6N_{20}/Fe_{66}N_{18}B_{16}$ bilayer films is provided in Table 6.

TABLE 6

| FeNB thickness in FeTaN(50 nm)/FeNB/Glass (nm) | 0.5 GHz μ' | 0.5 GHz tanδ | 1 GHz u' | 1 GHz tanδ | 1.5 GHz u' | 1.5 GHz tanδ | $f_r$ (GHz) | Snoek product ($\times 10^{12}$) |
|---|---|---|---|---|---|---|---|---|
| 15 | 913 | 0.10 | 814 | 0.14 | 1621 | 0.55 | 1.70 | 1.55 |
| 20 | 1167 | 0.03 | 953 | 0.24 | 1882 | 0.78 | 1.61 | 1.88 |
| 22 | 1130 | 0.11 | 1168 | 0.13 | 2044 | 1.02 | 1.88 | 1.88 |

Figure 16:
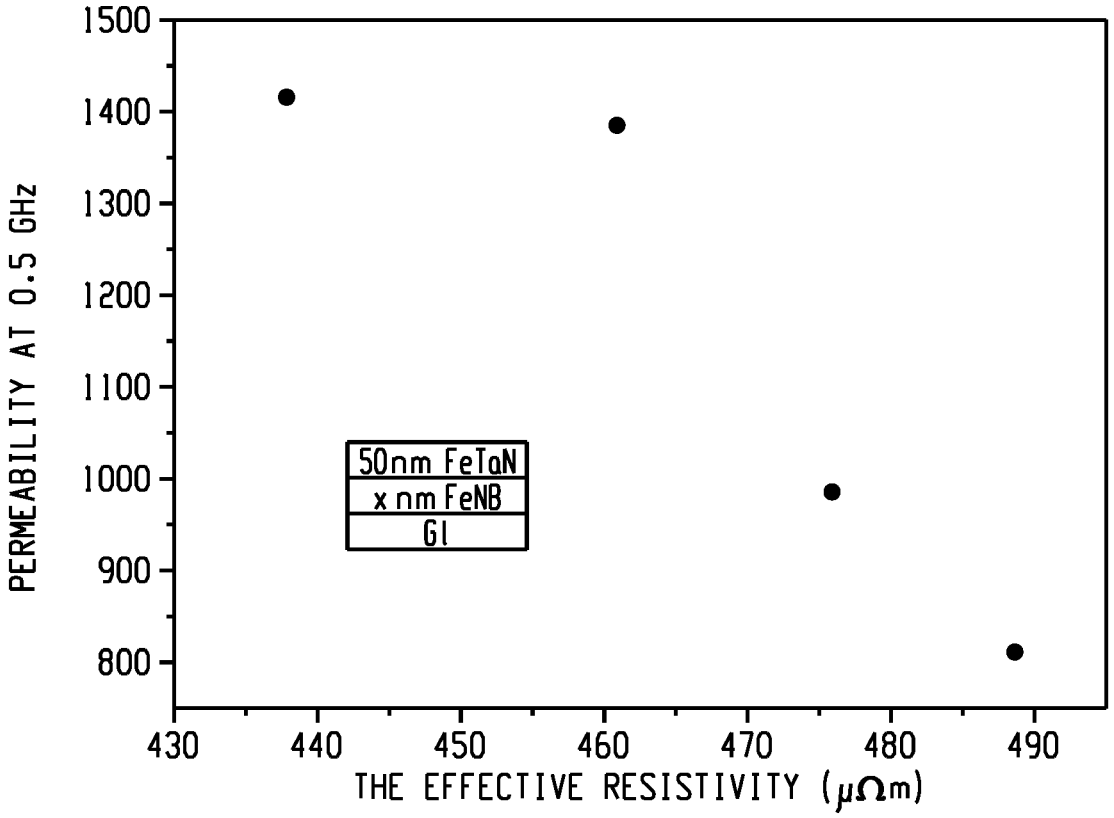
FIG. 16 shows the relationship between effective resistivity and magnetic permeability of an $Fe_{83}Ta_6N_{11}/Fe_{72}N_{18}B_{10}$/glass film with different thicknesses of an FeNB layer.

Resistivity Versus Magnetic Permeability (at 0.5 GHz) for a FeTaN/FeNB/Glass Structure With reference to FIG. 16, the effective resistivity of the FeNB/FeTaN film was affected by the thickness of the FeNB layer. The effective resistivity increased from 438 μΩm to 489 μΩm with an increase of the FeNB thickness from 60 nm to 75 nm. High magnetic permeability was exhibited in a resistivity range from 430 to 460 μΩm.

Figure 17:
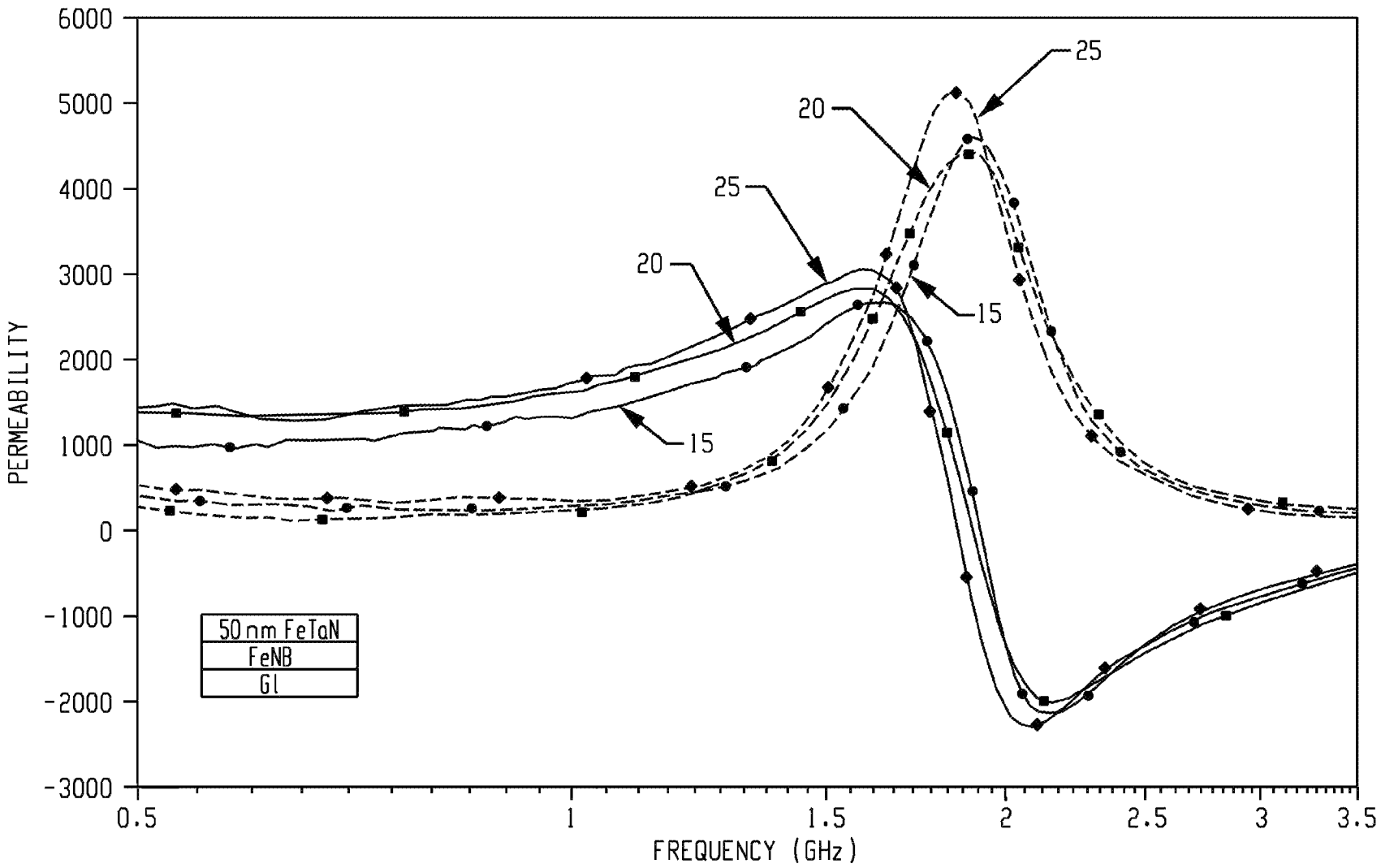
FIG. 17 is magnetic spectra for $Fe_{74}Ta_6N_{20}/Fe_{72}N_{18}B_{10}$ bi-layer films.

Example 4: FeTaN/FeNB/Glass Bi-Layer Film Structure with Low Level of Boron Content Parameters for RF Magnetron Sputtering RF Power=80 to 120 W
Deposition pressure=0.3 to 0.6 pascals (Pa)
Distance between target and substrate=8 centimeters (cm)
Working gas: Ar (99.5%); Reaction gas: Nitrogen (99.0%)
Target:
Iron (99.5%), 2-inch disk
2 pieces of boron (99.5%) chip with 5×5 $mm^2$
1 piece for tantalum (99.99%) (5×5 $mm^2$)
Deposition time: 5 to 30 minutes
Deposition temperature: ambient
Substrate: Optical glass Magnetic Permeability Spectrum of in FeTaN/FeNB Film with Low Level of B Concentration With reference to FIG. 17, the FeTaN film had a composition of $Fe_{74}Ta_6N_{20}$ measured by EDXS, and FeNB had a composition of $Fe_{72}N_{18}B_{10}$ FIG. 17 shows μ' (solid lines) and μ" (dashed lines) for varying thicknesses of the $Fe_{72}N_{18}B_{10}$ film in nm as indicated on the figure. A summary of magnetic spectrum measurements for $Fe_{74}Ta_6N_{20}/Fe_{72}N_{18}B_{10}$ bilayer films on a glass substrate is provided in Table 7.

TABLE 7

| FeNB thickness in FeTaN (50 nm)/FeNB/Glass (nm) | 0.5 GHz μ' | 0.5 GHz tanδ | 1 GHz u' | 1 GHz tanδ | 1.5 GHz u' | 1.5 GHz tanδ | $f_r$ (GHz) | Snoek product ($\times 10^{12}$) |
|---|---|---|---|---|---|---|---|---|
| 15 | 985 | 0.52 | 1716 | 0.18 | 2850 | 0.54 | 1.90 | 1.87 |
| 20 | 1386 | 0.18 | 1602 | 0.12 | 2680 | 0.51 | 1.87 | 2.59 |
| 22 | 1416 | 0.27 | 1796 | 0.16 | 2351 | 0.47 | 1.83 | 2.59 |

Figure 18:
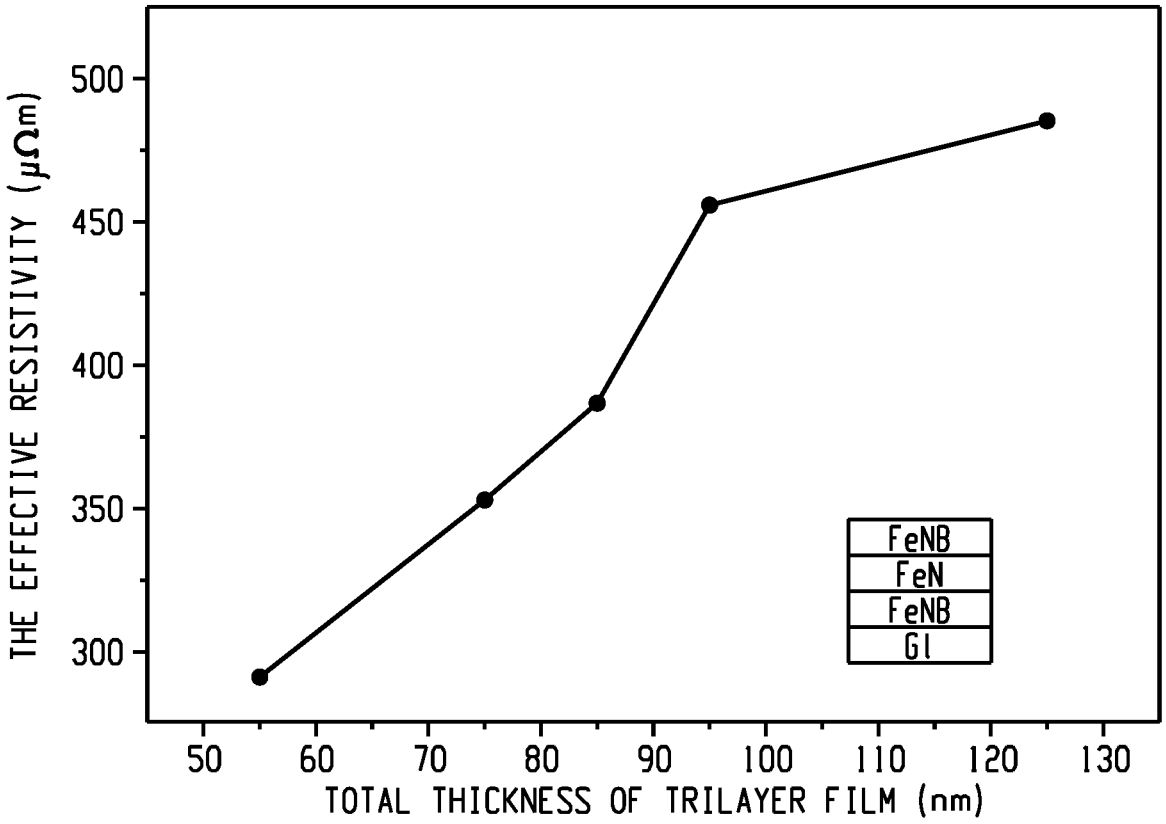
FIG. 18 shows the relationship between effective resistivity and total tri-layer film thickness of $Fe_{72}N_{18}B_{10}/Fe_{83}N_{11}/Fe_{72}N_{18}B_{10}$ tri-layer films.

Example 5: FeNB/FeN/FeNB/Glass Tri-Layered Structure Parameters for RF Magnetron Sputtering RF Power=80 to 120 W
Deposition pressure=0.3 to 0.6 pascals (Pa)
Distance between target and substrate=8 centimeters (cm)
Working gas: Ar (99.5%); Reaction gas: Nitrogen (99.0%)
Target:
Iron (99.5%), 2-inch disk
2 pieces of boron (99.5%) chip with 5×5 $mm^2$
1 piece for tantalum (99.99%) (5×5 $mm^2$)
Deposition time: 5 to 30 minutes
Deposition temperature: ambient
Substrate: Optical glass Resistivity of FeNB/FeN/FeNB Structure With reference to FIG. 18, the effective resistivity of a tri-layer film was measured by the V.D. Pauw method with four probes. The resistivity increased from 291 to 485 μΩm for the total thickness of the tri-layer film from 55 to 125 nm. Details of film thickness and resistivity for $Fe_{72}N_{18}B_{10}/Fe_{82}N_{18}/Fe_{72}N_{18}B_{10}$ tri-layer films are provided in Table 8.

TABLE 8

| Top layer FeNB (nm) | Middle layer FeN (nm) | Bottom layer FeNB (nm) | Total thickness (nm) | Resistivity (μΩm) |
|---|---|---|---|---|
| 15 | 20 | 20 | 55 | 291 |
| 15 | 30 | 30 | 75 | 351 |
| 15 | 35 | 35 | 85 | 386 |
| 20 | 50 | 25 | 95 | 455 |
| 25 | 50 | 50 | 125 | 485 |

Magnetic Permeability for FeNB/FeN/FeNB/Glass Structure

Figure 19:
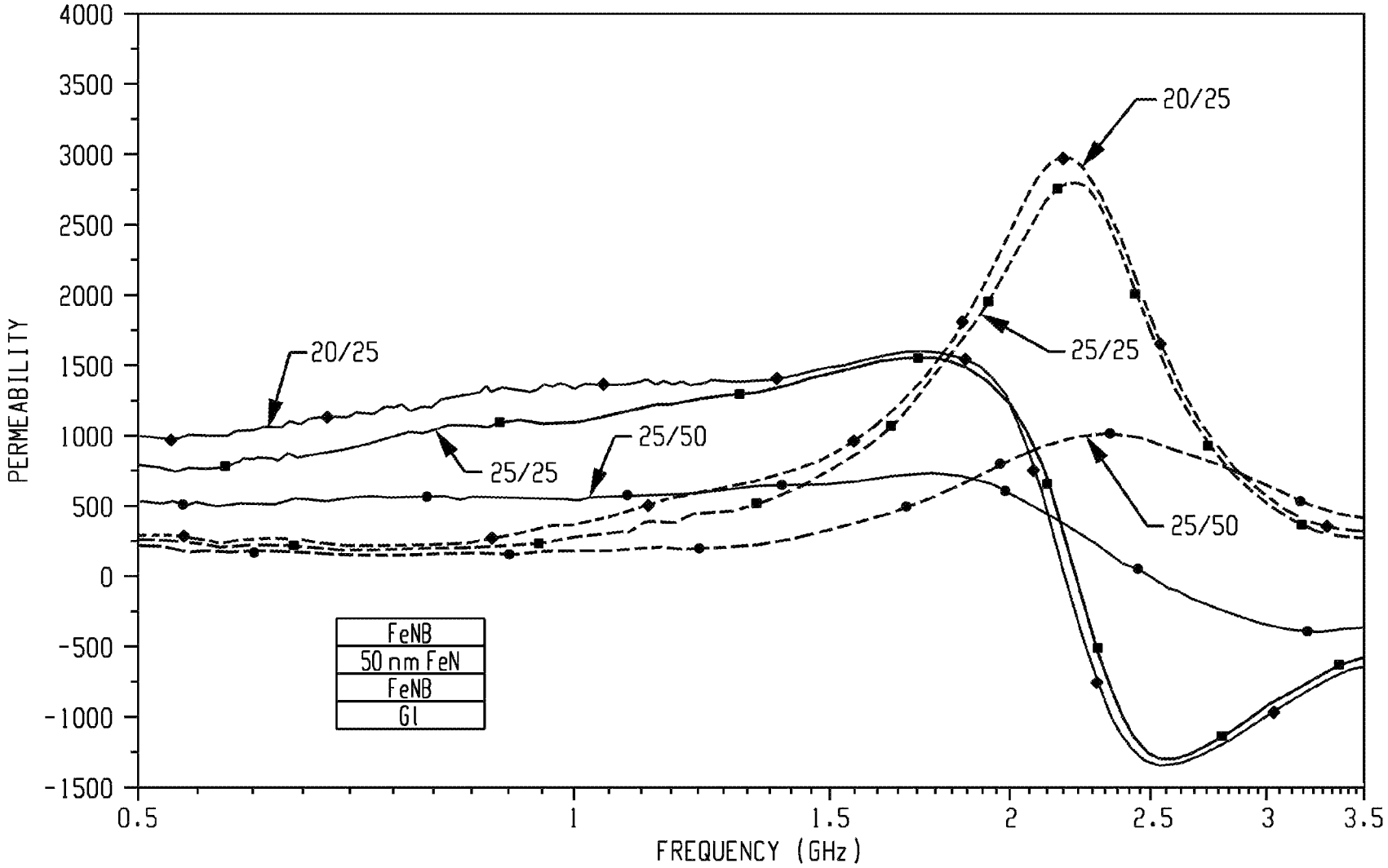
FIG. 19 is magnetic spectra of $Fe_{72}N_{18}B_{10}/Fe_{82}N_{18}/Fe_{82}N_{18}B_{10}$ tri-layer films.

With reference to FIG. 19, the thickness of 50 nm for the FeN middle layer was fixed and the thicknesses of the top and bottom FeNB layer were changed. FIG. 19 shows μ" (solid lines) and μ" (dashed lines) for varying thicknesses of the top and bottom FeNB films in nm as indicated on the figure. The increased magnetic permeability (at 0.5 GHz) and Snoek product were 995 and 2.16 for the FeNB(20 nm)/FeN(50 nm)/FeNB(25 nm) structures, respectively. Magnetic permeability of the FeNB(20 nm)/FeN(50 nm)/FeNB(25 nm) structure was about 50% higher than the FeNB(25 nm)/FeTaN(50 nm)/FeNB(25 nm) structure. A summary of magnetic spectrum measurements for $Fe_{72}N_{18}B_{10}/Fe_{82}N_{18}/Fe_{72}N_{18}B_{10}$ tri-layer films is shown in Table 9. The last row includes details of the reference sample.

TABLE 9

| Top layer FeNB (nm) | Middle layer FeN (nm) | Bottom layer FeNB (nm) | μ' at 0.5 GHz μ' | μ' at 0.5 GHz tanδ | μ' at 1.0 GHz μ' | μ' at 1.0 GHz tanδ | μ' at 1.5 GHz μ' | μ' at 1.5 GHz tanδ | $f_r$ (GHz) | Snoek product ($\times 10^{12}$) |
|---|---|---|---|---|---|---|---|---|---|---|
| 20 | 50 | 25 | 995 | 0.28 | 1339 | 0.27 | 1478 | 0.58 | 2.17 | 2.16 |
| 25 | 50 | 25 | 773 | 0.33 | 1096 | 0.25 | 1444 | 0.53 | 2.21 | 1.71 |
| 25 | 50 | 50 | 530 | 0.43 | 559 | 0.31 | 692 | 0.46 | 2.25 | 1.19 |
| 25 | 50 (FeTaN) | 25 | 382 | 0.41 | 457 | 0.16 | 464 | 0.96 | 1.79 | 0.68 |

Figure 20:
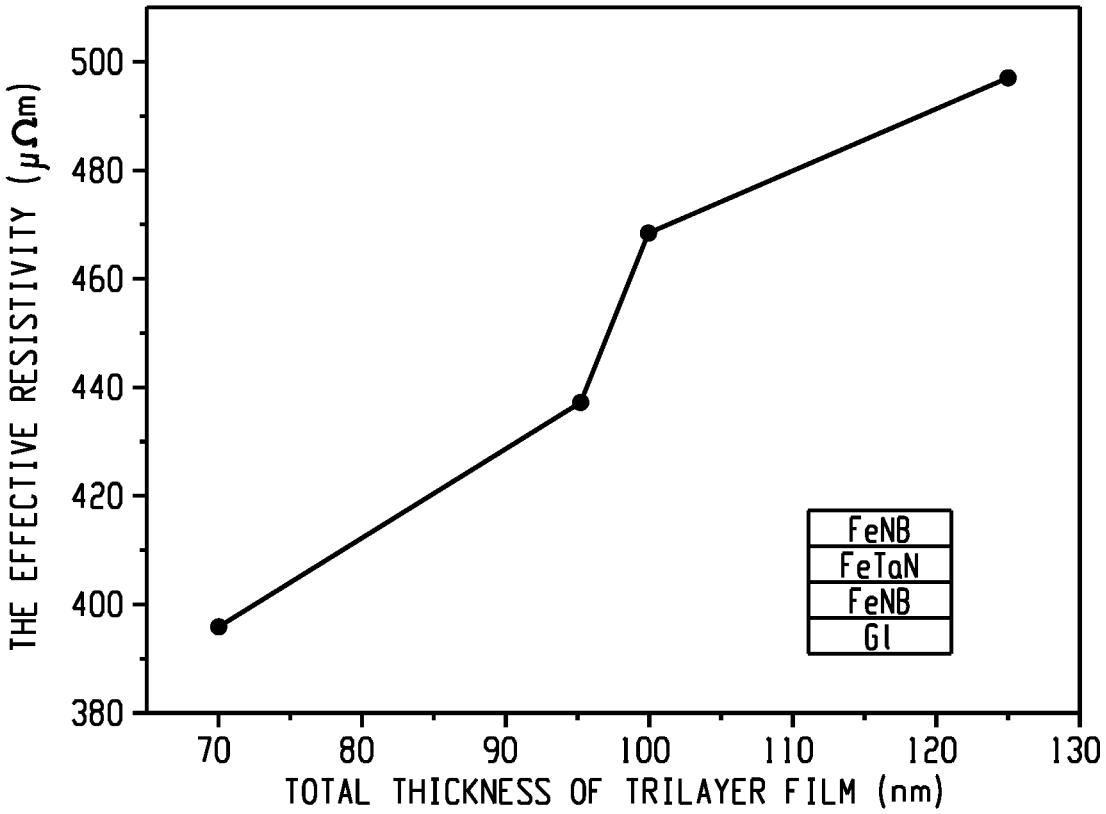
FIG. 20 shows the relationship between effective resistivity and total tri-layer film thickness of an $Fe_{72}N_{18}B_{10}/Fe_{83}Ta_6N_{18}/Fe_{72}N_{18}B_{10}$ tri-layered structure.

Example 6: FeNB/FeTaN/FeNB/Glass Tri-Layered Structure Parameters for RF Magnetron Sputtering RF Power=80 to 120 W
Deposition pressure=0.3 to 0.6 pascals (Pa)
Distance between target and substrate=8 centimeters (cm)
Working gas: Ar (99.5%); Reaction gas: Nitrogen (99.0%)
Target:
Iron (99.5%), 2-inch disk
2 pieces of boron (99.5%) chip with 2.5×2.5 $mm^2$
1 piece for tantalum (99.99%) (5×5 $mm^2$)
Deposition time: 5 to 30 minutes
Deposition temperature: ambient
Substrate: Optical glass Resistivity of FeNB/FeTaN/FeNB Structure With reference to FIG. 20, the effective resistivity increased with an increase of total thickness of the tri-layer FeNB/FeTaN/FeNB film. The effective resistivity increased from 391 to 496 μΩm for the total thickness from 70 to 125 nm. The effective resistivity of the FeNB/FeTaN/FeNB film was about 5% higher than that of the FeNB/FeN/FeNB film. Details of film thickness and resistivity for the $Fe_{72}N_{18}B_{10}/Fe_{83}Ta_6N_{11}/Fe_{72}N_{18}B_{10}$ tri-layer structure are provided in Table 10.

TABLE 10

| Top layer FeNB (nm) | Middle layer FeTaN (nm) | Bottom layer FeNB (nm) | Total thickness (nm) | Resistivity (μΩm) |
|---|---|---|---|---|
| 20 | 25 | 25 | 70 | 396 |
| 20 | 50 | 25 | 95 | 437 |
| 25 | 50 | 25 | 100 | 468 |
| 25 | 50 | 50 | 125 | 496 |

Magnetic Permeability for FeNB/FeTaN/FeNB/Glass Structure

Figure 21:
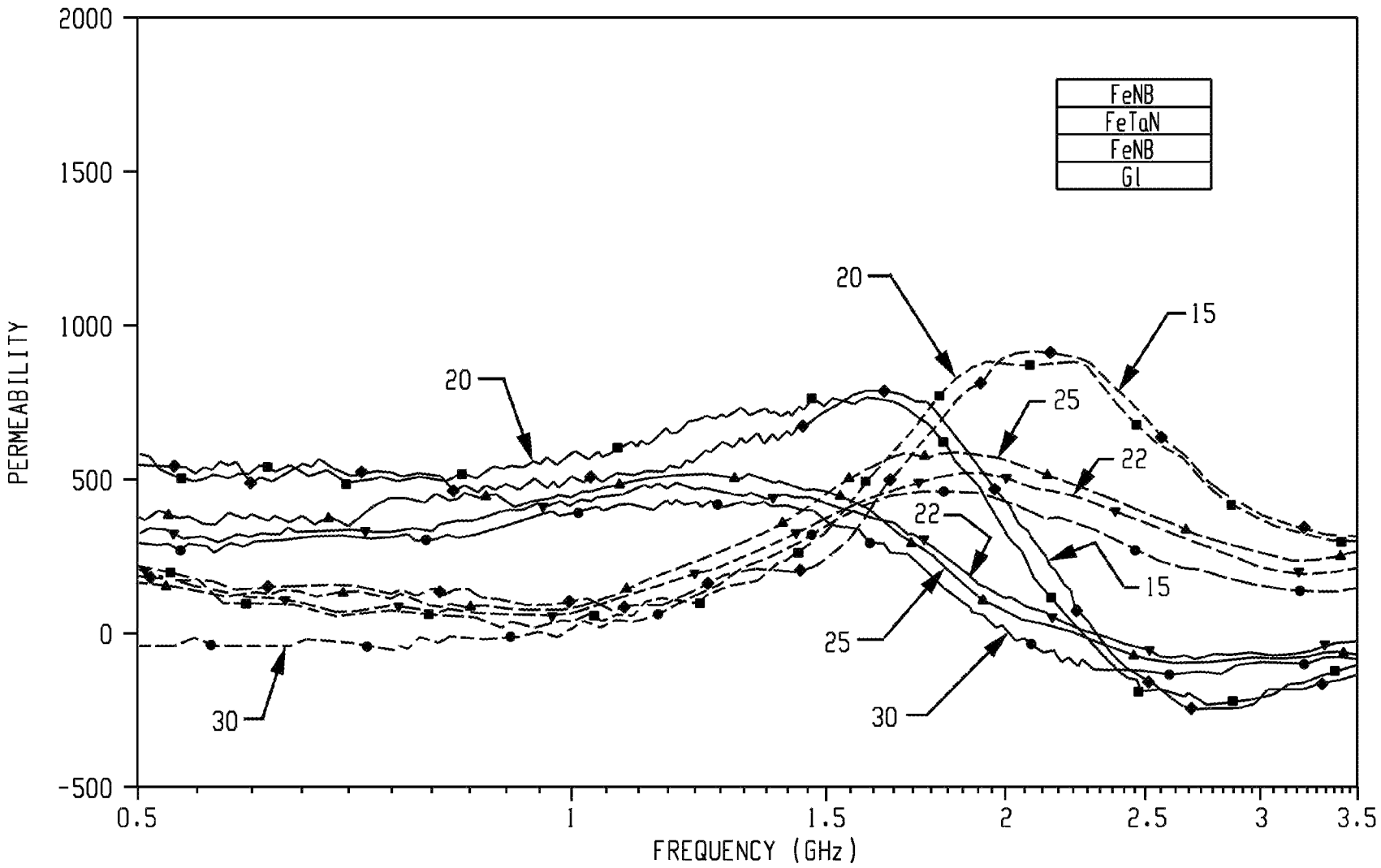
FIG. 21 is magnetic spectra of an $Fe_{72}N_{18}B_{10}/Fe_{72}Ta_{18}N_{10}/Fe_{72}N_{18}B_{10}$ tri-layered structure.

With reference to FIG. 21, the thickness of the FeNB and FeTaN layer varied from 20 nm to 50 nm. FIG. 21 shows μ' (solid lines) and μ" (dashed lines) for varying thicknesses of the top, middle, and bottom FeNB films in nm as indicated on the figure. The increased magnetic permeability (at 0.5 GHz) and Snoek product were 545 and 1.14 for the FeNB(20 nm)/FeTaN(25 nm)/FeNB(25 nm) structures, respectively. The magnetic permeability of the FeNB(20 nm)/FeTaN(25 nm)/FeNB(25 nm) structure was about 45% lower than that of the FeNB(20 nm)/FeN(50 nm)/FeNB(25 nm) structure (i.e., 995). A summary of magnetic spectrum measurements for $Fe_{72}N_{18}B_{10}/Fe_{72}Ta_{18}N_{10}/Fe_{72}N_{18}B_{10}$ tri-layer films is provided in Table 11. The last row includes details of the reference sample.

TABLE 11

| Top layer FeNB (nm) | Middle layer FeN (nm) | Bottom layer FeNB (nm) | μ' at 0.5 GHz μ' | μ' at 0.5 GHz tanδ | μ' at 1.0 GHz μ' | μ' at 1.0 GHz tanδ | μ' at 1.5 GHz μ' | μ' at 1.5 GHz tanδ | $f_r$ (GHz) | Snoek product ($\times 10^{12}$) |
|---|---|---|---|---|---|---|---|---|---|---|
| 20 | 25 | 25 | 545 | 0.31 | 504 | 0.11 | 712 | 0.35 | 2.09 | 1.14 |
| 25 | 25 | 25 | 511 | 0.41 | 599 | 0.07 | 747 | 0.49 | 2.08 | 1.06 |
| 20 | 50 | 25 | 319 | 0.62 | 429 | 0.23 | 425 | 0.83 | 1.86 | 0.59 |
| 25 | 50 | 25 | 382 | 0.41 | 457 | 0.16 | 464 | 0.96 | 1.79 | 0.68 |
| 25 | 50 | 50 | 292 | 0.02 | 397 | 0.04 | 382 | 0.91 | 1.76 | 0.52 |
| 20* | 50 (FeN) | 25 | 995 | 0.28 | 1366 | 0.27 | 1478 | 0.58 | 2.17 | 2.16 |

*Reference example

Figure 22:
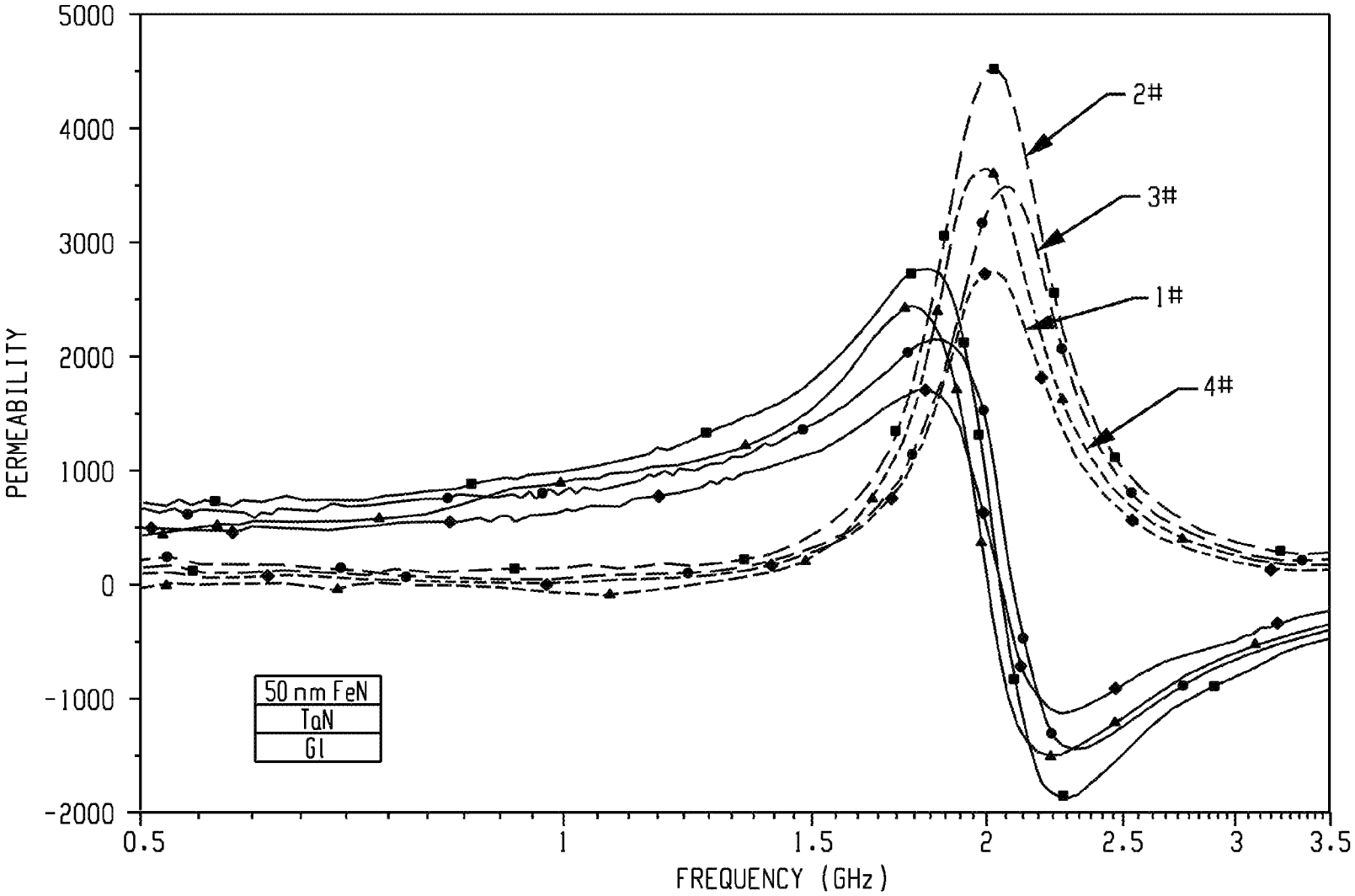
FIG. 22 is magnetic spectra for $Fe_{82}N_{18}/Ta_{88}N_{12}$ bilayer films.

Example 7: FeN, FeNB, FeTaN/TaN/Glass Bi-Layered Structure Parameters for RF Magnetron Sputtering RF Power=80 to 120 W
Deposition pressure=0.3 to 0.6 pascals (Pa)
Distance between target and substrate=8 centimeters (cm)
Working gas: Ar (99.5%); Reaction gas: Nitrogen (99.0%)
Target:
Iron (99.5%), 2-inch disk
2 pieces of boron (99.5%) chip with 2.5×2.5 $mm^2$
1 piece for tantalum (99.99%) (5×5 $mm^2$)
Deposition time: 5 to 30 minutes
Deposition temperature: ambient
Substrate: Optical glass Magnetic Permeability for FeN/TaN/Glass Structure With reference to FIG. 22, a non-magnetic TaN film was a seed layer for the deposition of a 50 nm FeN film. FIG. 22 shows μ' (solid lines) and μ" (dashed lines) for varying thicknesses of the TaN films in nm as indicated on the figure. The thickness of non-magnetic TaN seed layer varied from 15 to 30 nm. The increased magnetic permeability and Snoek product were 716 at 0.5 GHz and 1.53 when the thickness of TaN layer was about 20 nm. The magnetic permeability of the FeN(50 nm)/TaN(20 nm)/Glass structure was about 20% lower than that of the FeN(50 nm)/FeTaN(10 nm)/Glass structure (i.e., 892). The magnetic seed layer resulted in frequency permeability higher than that of the non-magnetic seed layer (e.g., TaN). A summary of magnetic spectrum measurements for $Fe_{82}N_{18}/Ta_{88}N_{12}$ bilayer films is provided in Table 12. The last row includes details of the reference sample.

TABLE 12

| Top layer | Bottom layer | μ' at 0.5 GHz | | μ' at 1.0 GHz | | μ' at 1.5 GHz | | $f_r$ | Snoek product |
|---|---|---|---|---|---|---|---|---|---|
| FeN (nm) | TaN (nm) | μ' | tanδ | μ' | tanδ | μ' | tanδ | (GHz) | ($\times 10^{12}$) |
| 50 | 15 | 507 | 0.22 | 558 | 0.05 | 1220 | 0.17 | 2.12 | 1.07 |
| 50 | 20 | 716 | 0.20 | 901 | 0.14 | 1939 | 0.17 | 2.13 | 1.53 |
| 50 | 25 | 646 | 0.34 | 778 | 0.05 | 1494 | 0.15 | 2.16 | 1.39 |
| 50 | 30 | 478 | 0.04 | 786 | 0.01 | 1648 | 0.09 | 2.09 | 1.00 |
| 50* | 20 (FeTaN) | 892 | 0.08 | 1145 | 0.13 | 1709 | 0.89 | 1.76 | 1.57 |

*Reference example

Magnetic Permeability for FeNB/TaN/Glass Structure

Figure 23:
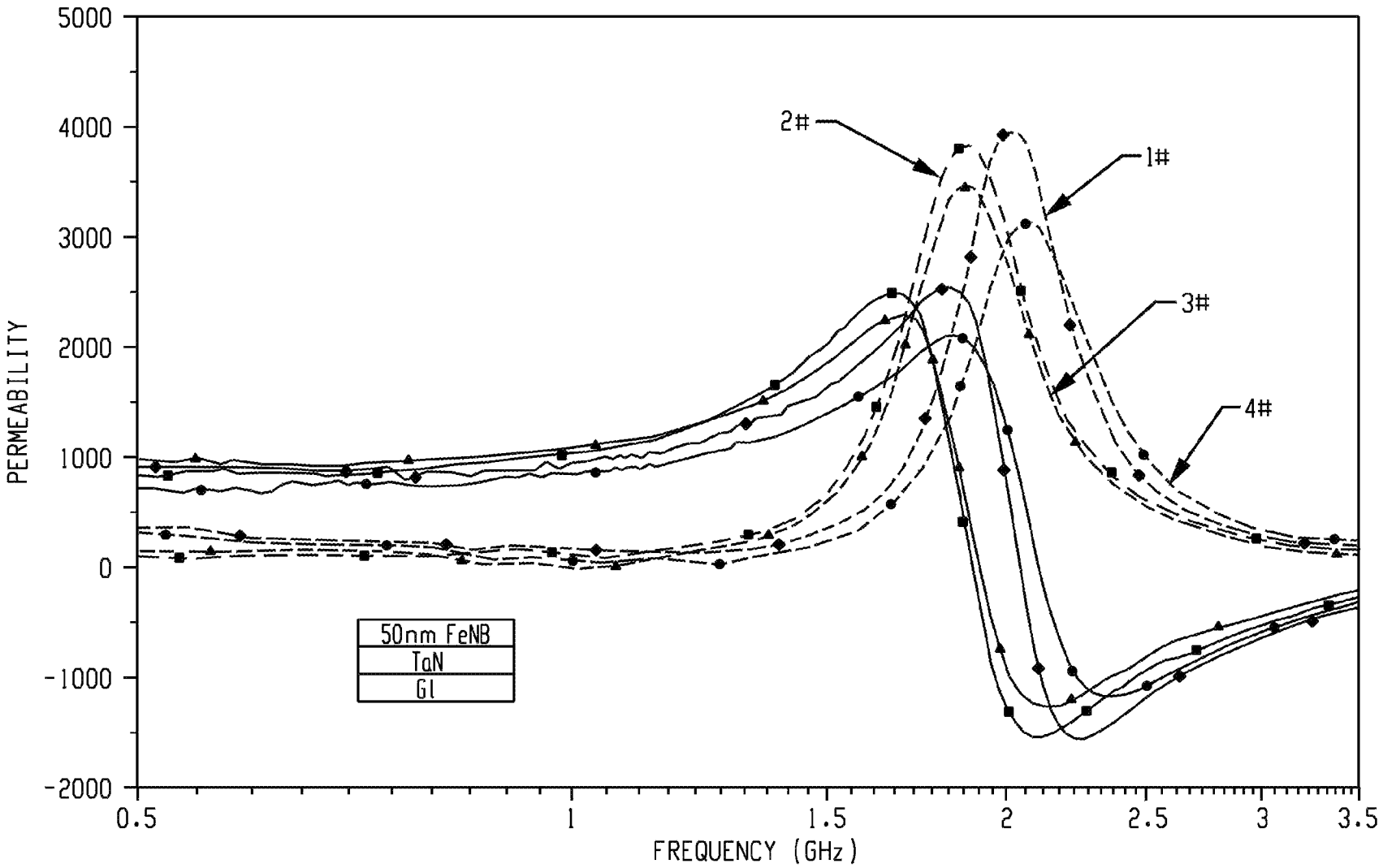
FIG. 23 is magnetic spectra for $Fe_{72}N_{18}B_{10}/Ta_{88}N_{12}$ bilayer films.

With reference to FIG. 23, the thickness of non-magnetic TaN seed layer varied from 10 nm to 25 nm. FIG. 23 shows μ' (solid lines) and μ" (dashed lines) for varying thicknesses of the TaN films in nm as indicated on the figure. The increased magnetic permeability and Snoek product were 937 at 0.5 GHz and 1.76 when the thickness of TaN seed layer was about 20 nm. The magnetic permeability of the FeN(50 nm)/TaN(20 nm)/Glass structure was about 32% lower than that of the FeNB(50 nm)/FeTaN(20 nm)/Glass structure (i.e., 1386). The magnetic permeability of the FeNB(50 nm)/TaN(20 nm)/Glass structure was about 24% higher than that of the FeN(50 nm)/TaN(20 nm)/Glass structure (i.e., 716). The magnetic seed layer demonstrated higher permeability than that of the non-magnetic seed layer. A summary of magnetic spectrum measurements for $Fe_{72}N_{18}B_{10}/Ta_{88}N_{12}$ bilayer films is provided in Table 12. The last two rows include details of the reference samples.

TABLE 12

| Top layer | Bottom layer | μ' at 0.5 GHz | | μ' at 1.0 GHz | | μ' at 1.5 GHz | | $f_r$ | Snoek product |
|---|---|---|---|---|---|---|---|---|---|
| FeN (nm) | TaN (nm) | μ' | tanδ | μ' | tanδ | μ' | tanδ | (GHz) | ($\times 10^{12}$) |
| 10 | 10 | 821 | 0.58 | 941 | 0.09 | 1598 | 0.20 | 2.01 | 1.65 |
| 15 | 15 | 866 | 0.11 | 1043 | 0.12 | 2004 | 0.33 | 1.87 | 1.23 |
| 20 | 20 | 937 | 0.17 | 1065 | 0.01 | 1827 | 0.32 | 1.88 | 1.76 |
| 25 | 25 | 708 | 0.43 | 862 | 0.13 | 1378 | 0.16 | 2.06 | 1.46 |
| 50* | 20 (FeTaN) | 1386 | 0.15 | 1581 | 0.13 | 2740 | 0.17 | 1.87 | 2.59 |
| 50 (FeN)* | 20 | 716 | 0.20 | 901 | 0.14 | 1939 | 0.17 | 2.13 | 1.53 |

*Reference example

Magnetic Permeability for FeTaN/TaN/Glass Structure

Figure 24:
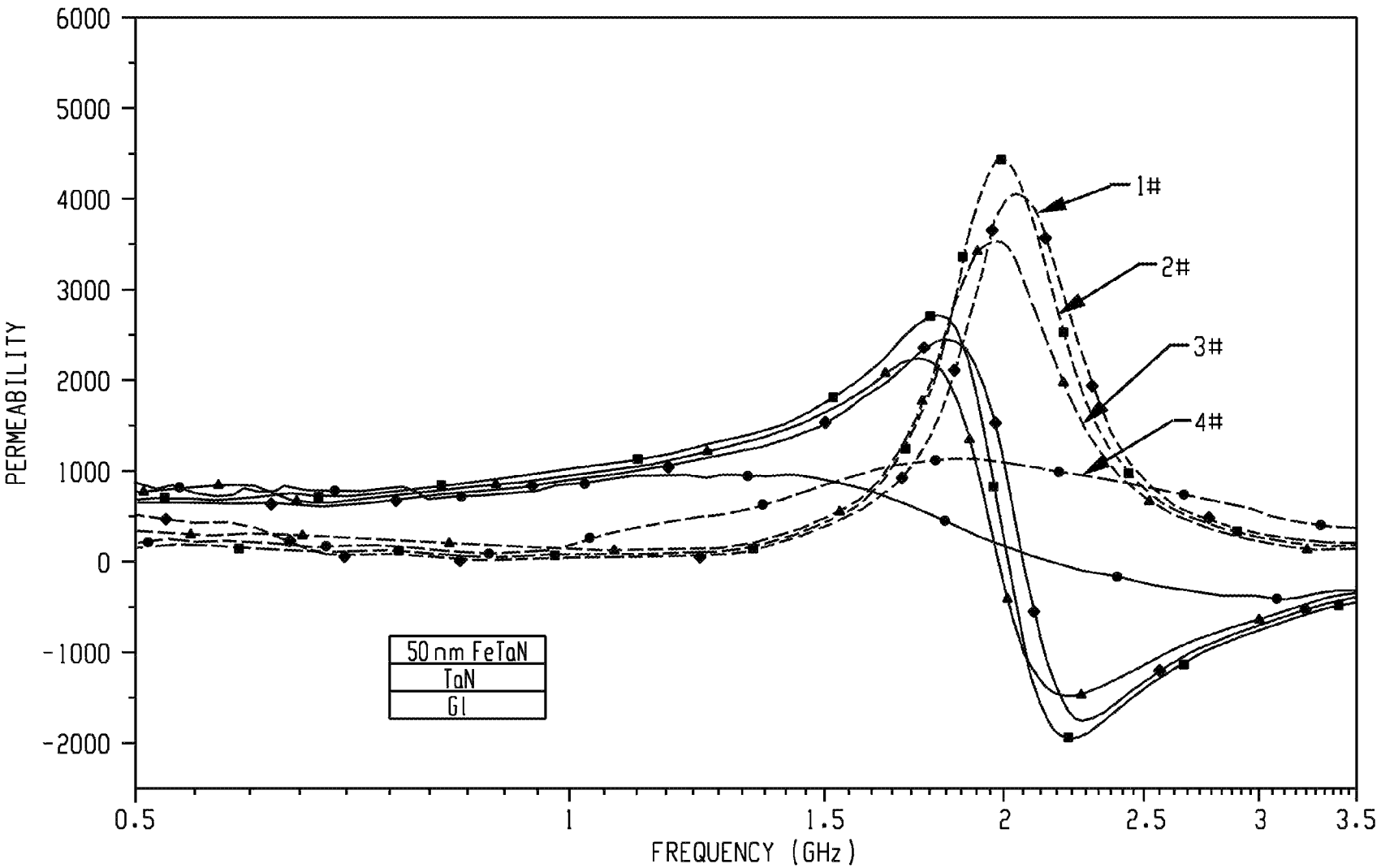
FIG. 24 is magnetic spectra for $Fe_{83}Ta_6N_{11}/Ta_{88}N_{12}$ bilayer films.

With reference to FIG. 24, the thickness of magnetic top FeTaN layer was fixed at 50 nm. FIG. 24 shows μ' (solid lines) and μ" (dashed lines) for varying thicknesses of the TaN films in nm as indicated on the figure. The thickness of nan-magnetic TaN layer varied from 10 nm to 25 nm. The increased magnetic permeability and Snoek product was 832 at 0.5 GHz and 1.63 when the thickness of TaN layer was about 20 nm. The magnetic permeability of the FeTaN(50 nm)/TaN(20 nm)/Glass structure was about 38% lower than of the FeTaN(50 nm)/FeNB(20 nm)/Glass structure (i.e., 1386). The magnetic permeability of the FeTaN(50 nm)/TaN(20 nm)/Glass structure was about 14% higher than that of the FeN(50 nm)/TaN(20 nm)/Glass structure (i.e., 716). A summary of magnetic spectrum measurements for $Fe_{83}Ta_6N_{11}/Ta_{88}N_{12}$ bilayer films is provided in Table 13. The last row includes details of the reference sample. The last two rows include details of the reference samples.

TABLE 13

| Top layer | Bottom layer | μ' at 0.5 GHz | | μ' at 1.0 GHz | | μ' at 1.5 GHz | | $f_r$ | Snoek product |
|---|---|---|---|---|---|---|---|---|---|
| FeN (nm) | TaN (nm) | μ' | tanδ | μ' | tanδ | μ' | tanδ | (GHz) | ($\times 10^{12}$) |
| 10 | 10 | 669 | 0.68 | 911 | 0.18 | 1538 | 0.29 | 2.03 | 1.36 |
| 15 | 15 | 714 | 0.49 | 1029 | 0.10 | 1814 | 0.25 | 1.99 | 1.42 |
| 20 | 20 | 832 | 0.38 | 975 | 0.15 | 1697 | 0.29 | 1.96 | 1.63 |
| 25 | 25 | 807 | 0.30 | 906 | 0.28 | 984 | 0.89 | 1.83 | 1.48 |
| 50 | 20 (FeNB) | 1386 | 0.20 | 1581 | 0.14 | 2740 | 0.17 | 1.87 | 2.59 |
| 20 (FeN) | 20 | 716 | 0.17 | 901 | 0.01 | 1939 | 0.32 | 2.13 | 1.53 |

Figure 25:
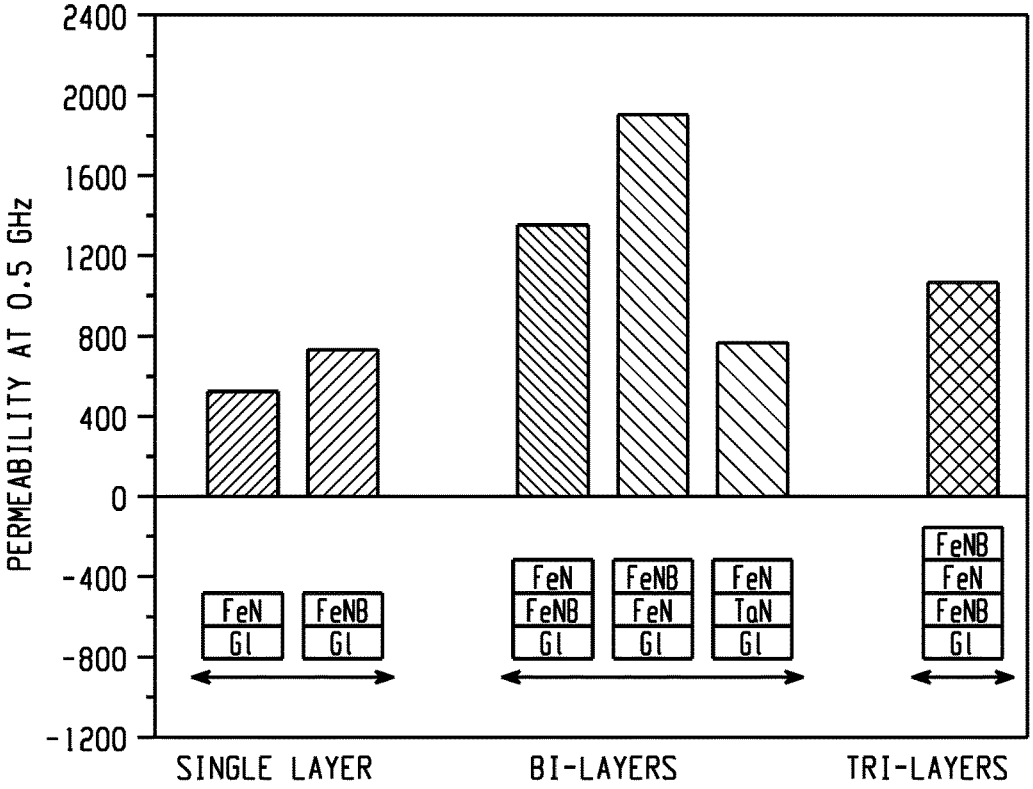
FIG. 25 shows magnetic permeability at 0.5 GHz for a single layer, bi-layer and tri-layer FeN-based films.

Example 8: Magnetic Permeability and Snoek Product Diagram of the FeN-Based or FeTaN-Based Multi-Layered Structure Magnetic Permeability (at 0.5 GHz) and Snoek Product Diagram of FeN-Based Structure With reference to FIG. 25, the magnetic permeability diagram at 0.5 GHz of the FeN-based film are provided for the single layer film, double layers film and triple layer structure. The increased magnetic permeability about 1800 was observed in the double-layered film with the 20~25 nm FeNB seed layer.

Figure 26:
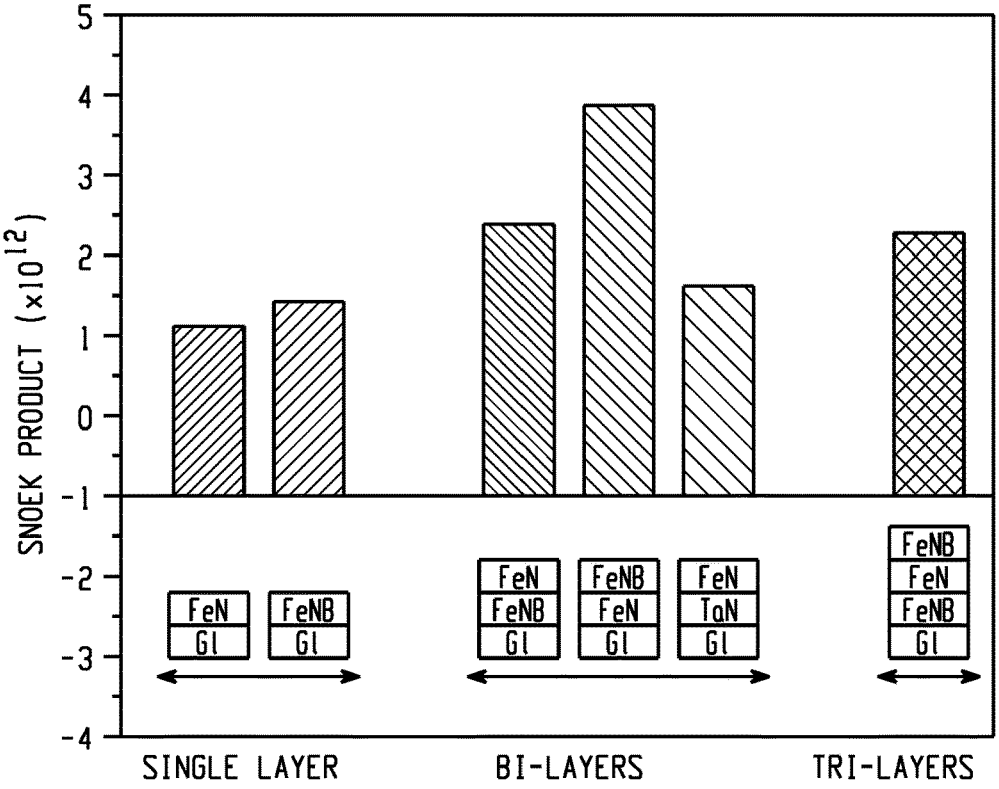
FIG. 26 is a Snoek product diagram at 0.5 GHz for a single layer, bi-layer and tri-layer FeN-based multi-layered structure.

With reference to FIG. 26, the Snoek product diagram of the FeN-based film are provided for the single layer film, double layers film and triple layers film. The increased Snoek product about $2.0–3.5\times10^{12}$ was observed in the double-layered film with the 20~25 nm FeNB seed layer.

Figure 27:
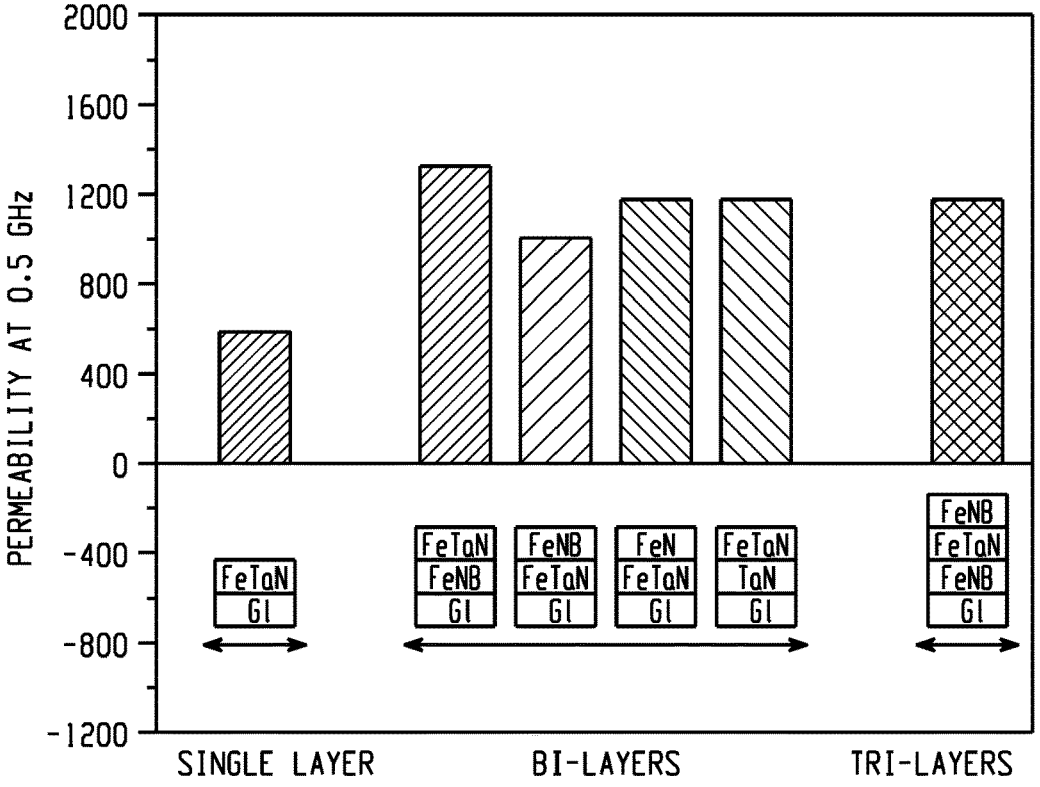
FIG. 27 shows magnetic permeability at 0.5 GHz for a single layer, bi-layer and tri-layer FeTaN-based multi-layered structure.

Magnetic Permeability (at 0.5 GHz) and Snoek Product Diagram of FeTaN-Based Structure With reference to FIG. 27, the magnetic permeability diagram of the FeTaN-based film is provided for the single layer film, double layers film and triple layers film. The increased magnetic permeability about 1300 was observed in the double-layered film with the 20~25 nm FeNB seed layer.

Figure 28:
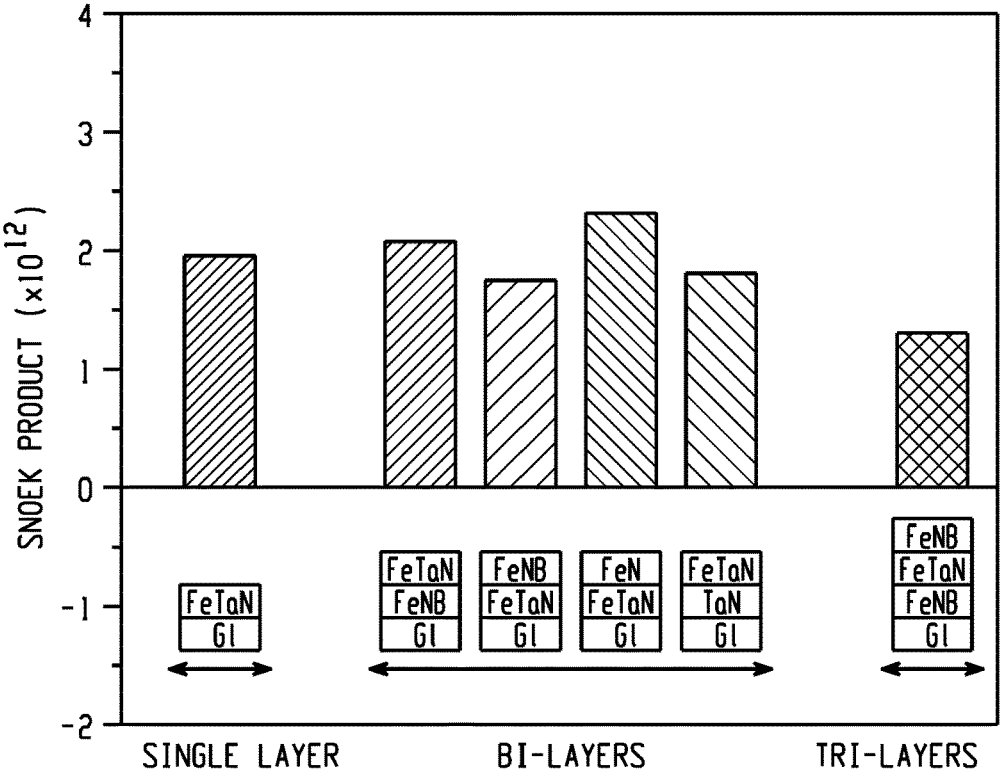
FIG. 28 is a Snoek product diagram at 0.5 GHz for a single layer, bi-layer and tri-layer FeTaN-based multi-layered structure.

With reference to FIG. 28, the Snoek product diagram of the FeTaN-based film are provided for the single layer film, bi-layer film and triple-layer structure. The increased Snoek product about $2.0\times10^{12}$ was observed in the double-layered film with the 20~25 nm FeTaN or FeNB seed layer.

Set forth below are some aspects of the multilayer magnetic film, articles comprising the same, and methods of making the same.

Aspect 1: A multilayer magnetic film, comprising: a substrate; a first magnetic layer disposed on the substrate, wherein the first magnetic layer comprises $Fe_{(50-80)}N_{(10-20)}B_{(1-20)}M_{(0-10)}$, wherein M is Si, Ta, Zr, Ti, Co, or a combination thereof; and a second magnetic layer disposed on the first magnetic layer, wherein the second magnetic layer comprises $Fe_{(50-90)}N_{(10-50)}$ or $Fe_{(60-90)}N_{(1-10)}Ta_{(5-30)}$; wherein the multilayer magnetic film has, over a frequency range of 50 MHz to 10 GHz, preferably over a frequency range of 100 MHz to 5 GHz, more preferably over a frequency range of 1 to 5 GHz, a magnetic permeability of greater than or equal to 1800, preferably greater than 2000, more preferably greater than 3000, or 1800 to 5000 over a selected frequency band in the frequency range, preferably over a frequency band of 1 to 10 GHz; a magnetic loss tangent of less than or equal to 0.3, preferably less than or equal to 0.1, or 0.01 to 0.3 over a selected frequency band in the frequency range, preferably over a frequency band of 1 to 10 GHz; and a cutoff frequency of greater than or equal to 1 GHz, greater than or equal to 1 GHz, or greater than or equal to 2 GHz, preferably greater than or equal to 5 GHz, or 1 to 8 GHz.

Aspect 2: The multilayer magnetic film of Aspect 1, wherein the substrate comprises a glass, polymer, or ceramic, preferably a ceramic.

Aspect 3: The multilayer magnetic film of any one or more of the preceding Aspects, wherein the first magnetic layer has a thickness of 10 to 100 nanometers, and the second magnetic layer has a thickness of 10 to 400 nanometers.

Aspect 4: The multilayer magnetic film of any one or more of the preceding Aspects, further comprising: an additional first layer comprising $Fe_{(50-80)}N_{(10-20)}B_{(1-20)}$ disposed on the second layer; and an additional second magnetic layer comprising $Fe_{(50-90)}N_{(10-50)}$ or $Fe_{(60-90)}N_{(1-10)}Ta_{(5-30)}$ disposed on the additional first magnetic layer.

Aspect 5: The multilayer magnetic film of Aspect 4, comprising further additional first and second magnetic layers disposed on the additional second magnetic layer in alternation.

Aspect 6: The multilayer magnetic film of any one or more of Aspects 4 to 5, wherein the first magnetic layer and the second magnetic layer have a total thickness of 20 to 500 nanometers.

Aspect 7: An article comprising the multilayer film of any one or more of Aspects 1 to 6, preferably wherein the article is a filter, transformer, inductor, antenna, electronic integrated circuit chip, or electromagnetic shielding device.

Aspect 8: The article of Aspect 7, wherein the article is a component of an electronic device, preferably a mobile phone, a desktop computer, a laptop computer, a notebook computer, a wireless or LAN network, a power supply, an amplifier, a voltage-controlled oscillator, a shrink power converter, more preferably an integrated electronic device.

Aspect 9: A method of forming the multilayer magnetic film of any one or more of Aspects 1 to 6, the method comprising: depositing the first magnetic layer onto a side of the substrate; and depositing the second magnetic layer onto a side of the first magnetic layer opposite to the substrate.

Aspect 10: The method of Aspect 9, wherein the depositing comprises rf/DC sputtering, electron beam deposition, or a combination thereof.

Aspect 11: The method of Aspect 10, further comprising depositing an additional first layer on a side of the second layer opposite the first layer.

Aspect 12: The method of Aspect 11, further comprising depositing an additional second layer on a side of the additional first layer opposite the second layer.

Aspect 13: The method of any one or more of Aspects 9 to 12, comprising adjusting the thickness of each layer to adjust the magnetic loss tangent of the multilayer magnetic film, the magnetic anisotropy of the magnetic multilayer film, or both.

Aspect 14: A multilayer magnetic film made by the method of any one or more of Aspects 9 to 13.

"Film" as used herein includes planar layers, sheets, and the like as well as other three-dimensional non-planar forms. A layer can further be macroscopically continuous or non-continuous. As used herein, "a," "an," "the," and "at least one" do not denote a limitation of quantity, and are intended to cover both the singular and plural, unless the context clearly indicates otherwise. For example, "an element" has the same meaning as "at least one element," unless the context clearly indicates otherwise. "Or" means "and/or." Ranges disclosed herein are inclusive of the recited endpoint and are independently combinable. "Combination" is inclusive of blends, mixtures, alloys, reaction products, and the like. Also, "combination thereof" means that the list is inclusive of each element individually, as well as combinations of two or more elements of the list, and combinations of at least one element of the list with like elements not named. The terms "first," "second," and so forth, herein do not denote any order, quantity, or importance, but rather are used to distinguish one element from another. While certain combinations of features have been described herein, it will be appreciated that these certain combinations are for illustration purposes only and that any combination of any of these features can be employed, explicitly or equivalently, either individually or in combination with any other of the features disclosed herein, in any combination, and all in accordance with an embodiment. Any and all such combinations are contemplated herein and are considered within the scope of the disclosure. Unless otherwise stated, the test standards are the latest as of the date of filing.

The endpoints of all ranges directed to the same component or property are inclusive of the endpoints, are independently combinable, and include all intermediate points and ranges. For example, ranges of "up to 25, or 5 to 20" is inclusive of the endpoints and all intermediate values of the ranges of "5 to 25" such as 10 to 23, etc.

Unless defined otherwise, technical and scientific terms used herein have the same meaning as is commonly understood by one of skill in the art to which this invention belongs. All cited patents, patent applications, and other references are incorporated herein by reference in their entirety. However, if a term in the present application contradicts or conflicts with a term in the incorporated reference, the term from the present application takes precedence over the conflicting term from the incorporated reference.

While the disclosure has been described with reference to exemplary embodiments, it will be understood by those skilled in the art that various changes can be made, and equivalents can be substituted for elements thereof without departing from the scope of this disclosure. In addition, many modifications can be made to adapt a particular situation or material to the teachings without departing from the essential scope thereof. Therefore, it is intended that the disclosure not be limited to the particular embodiment disclosed as the best or only mode contemplated for carrying out this disclosure, but that the disclosure will include all embodiments falling within the scope of the appended claims. Also, in the drawings and the description, there have been disclosed exemplary embodiments and, although specific terms can have been employed, they are unless otherwise stated used in a generic and descriptive sense only and not for purposes of limitation.

What is claimed is:

1. A multilayer magnetic film, comprising:

a substrate;

a first magnetic layer disposed on the substrate, wherein the first magnetic layer comprises $Fe_{(50-80)}N_{(10-20)}B_{(1-20)}M_{(0-10)}$, wherein M is Si, Ta, Zr, Ti, Co, or a combination thereof; and a second magnetic layer disposed on the first magnetic layer, wherein the second magnetic layer comprises $Fe_{(50-90)}N_{(10-50)}$ or $Fe_{(60-90)}N_{(1-10)}Ta_{(5-30)}$;

wherein the multilayer magnetic film has, over a frequency range of 50 MHz to 10 GHz, a magnetic permeability of greater than or equal to 1800 over a selected frequency band in the frequency range;

a magnetic loss tangent of less than or equal to 0.3 over a selected frequency band in the frequency range; and a cutoff frequency of greater than or equal to 1 GHz.

2. The multilayer magnetic film of claim 1, wherein the substrate comprises a glass, polymer, or ceramic.

3. The multilayer magnetic film of claim 1, wherein the first magnetic layer has a thickness of 10 to 100 nanometers, and the second magnetic layer has a thickness of 10 to 400 nanometers.

4. The multilayer magnetic film of claim 1, further comprising:

an additional first layer comprising $Fe_{(50-80)}N_{(10-20)}B_{(1-20)}$ disposed on the second layer; and an additional second magnetic layer comprising $Fe_{(50-90)}N_{(10-50)}$ or $Fe_{(60-90)}N_{(1-10)}Ta_{(5-30)}$ disposed on the additional first magnetic layer.

5. The multilayer magnetic film of claim 4, comprising further additional first and second magnetic layers disposed on the additional second magnetic layer in alternation.

6. The multilayer magnetic film of claim 4, wherein the first magnetic layer and the second magnetic layer have a total thickness of 20 to 500 nanometers.

7. An article comprising the multilayer film of claim 1.

8. The article of claim 7, wherein the article is a component of an electronic device.

9. A method of forming the multilayer magnetic film of claim 1, the method comprising:

depositing the first magnetic layer onto a side of the substrate; and depositing the second magnetic layer onto a side of the first magnetic layer opposite to the substrate.

10. The method of claim 9, wherein the depositing comprises rf/DC sputtering, electron beam deposition, or a combination thereof.

11. The method of claim 10, further comprising depositing an additional first layer on a side of the second layer opposite the first layer.

12. The method of claim 11, further comprising depositing an additional second layer on a side of the additional first layer opposite the second layer.

13. The method of claim 9, comprising adjusting the thickness of each layer to adjust the magnetic loss tangent of the multilayer magnetic film, the magnetic anisotropy of the magnetic multilayer film, or both.

* * * * *